US007625451B2

(12) United States Patent
Chasen et al.

(10) Patent No.: US 7,625,451 B2
(45) Date of Patent: Dec. 1, 2009

(54) METHOD AND APPARATUS FOR CLEANING THE CUTTING SYSTEM OF AN ELECTRIC SHAVER

(75) Inventors: James E. Chasen, West Haven, CT (US); Scott Larsen, Newtown, CT (US); Frank Mercurio, Wallingford, CT (US); Stephen D. Mowers, Fairfield, CT (US); Timothy G. Simmone, Old Saybrook, CT (US)

(73) Assignee: Rovcal, Inc., Madison, WI (US)

( * ) Notice: Subject to any disclaimer, the term of this patent is extended or adjusted under 35 U.S.C. 154(b) by 0 days.

(21) Appl. No.: 12/030,027

(22) Filed: Feb. 12, 2008

(65) Prior Publication Data

US 2008/0210271 A1 Sep. 4, 2008

Related U.S. Application Data

(63) Continuation of application No. 10/541,669, filed as application No. PCT/US2004/000112 on Jan. 5, 2004, now Pat. No. 7,361,232.

(51) Int. Cl.
*B08B 3/04* (2006.01)

(52) U.S. Cl. ..... 134/10; 134/22.18; 134/111; 134/169 R; 134/170; 134/186

(58) Field of Classification Search ..... 134/166 R, 134/186, 111, 184, 198
See application file for complete search history.

(56) References Cited

U.S. PATENT DOCUMENTS

| | | | |
|---|---|---|---|
| 3,167,804 | A | 2/1965 | Naumann |
| 3,172,416 | A | 3/1965 | Simmons |
| 3,295,204 | A | 1/1967 | Brophy |
| 3,318,103 | A | 5/1967 | Jakob |
| 3,328,103 | A | 6/1967 | Bennett |
| 3,364,068 | A | 1/1968 | Stern |
| 3,365,267 | A | 1/1968 | Me Kiney et al. |
| 3,396,462 | A | 8/1968 | Dufresne |
| 3,584,633 | A | 6/1971 | Arrigo |

(Continued)

FOREIGN PATENT DOCUMENTS

| | | |
|---|---|---|
| DE | 2429372 | 1/1976 |

(Continued)

OTHER PUBLICATIONS

No References Cited on 892, All Pertinent References Cited on PTO 1449.*

*Primary Examiner*—Frankie L Stinson
(74) *Attorney, Agent, or Firm*—Armstrong Teasdale LLP

(57) ABSTRACT

By providing a shaver receiving and supporting housing which is constructed for enabling cleaning fluid to be delivered directly to the interior of a shaver in a highly efficient manner, a fully integrated shaving cleaning system is realized which is capable of providing automated cleaning of the shaver in an efficient and effective manner. In accordance with the present invention, the cleaning fluid if forced through portals formed in the shaver for enabling the fluid to be forcibly delivered directly into the hair pocket of the shaver, thereby enabling the surfaces of the hair pocket, the cutting foils, and the cutting blades to be completely and thoroughly cleaned, with the fluid draining out of the shaver through the cutting foils. In addition, the present invention is constructed for thoroughly and completely cleaning both rotary shavers and foil shavers.

16 Claims, 15 Drawing Sheets

U.S. PATENT DOCUMENTS

| | | | | |
|---|---|---|---|---|
| 4,054,963 | A | | 10/1977 | Taylor |
| 4,549,352 | A | | 10/1985 | Ochiai et al. |
| 4,631,825 | A | | 12/1986 | Kuriyama et al. |
| 4,721,124 | A | * | 1/1988 | Tuerkheimer et al. ..... 134/138 |
| 5,143,101 | A | | 9/1992 | Mor |
| 5,614,030 | A | | 3/1997 | Braun |
| 5,649,556 | A | | 7/1997 | Braun |
| 5,711,328 | A | | 1/1998 | Braun |
| 5,933,961 | A | | 8/1999 | Oakey |
| 6,189,215 | B1 | | 2/2001 | Beerwerth et al. |
| 6,226,870 | B1 | | 5/2001 | Barish |
| 6,233,535 | B1 | | 5/2001 | Petretty |
| 6,263,890 | B1 | | 7/2001 | Hoser |
| 6,305,391 | B1 | | 10/2001 | Hoser |
| 6,371,136 | B1 | | 4/2002 | Hoser |
| 6,530,150 | B1 | | 3/2003 | Barish |
| 2002/0069902 | A1 | | 6/2002 | Hoser et al. |
| 2002/0170583 | A1 | | 11/2002 | Wong |

FOREIGN PATENT DOCUMENTS

| | | |
|---|---|---|
| FR | 2568111 | 1/1986 |
| GB | 2167953 | 6/1986 |
| JP | 06178876 | 6/1994 |
| WO | 2004062420 A2 | 7/2004 |

* cited by examiner

METHOD AND APPARATUS FOR CLEANING THE CUTTING SYSTEM OF AN ELECTRIC SHAVER

CROSS REFERENCE TO RELATED APPLICATION

This application is a continuation of U.S. patent application Ser. No. 10/541,669 filed Jul. 7, 2005, which is incorporated herein in its entirety.

BACKGROUND

This invention relates to electric dry shavers and, more particularly, to improved cutting systems for shavers and automated cleaning systems therefor.

Over the last several years, both men and women have been increasingly drawn to the advantages provided by electric dry shavers. In general, the consuming public has found that the use of razors or other systems is extremely inconvenient for removing or shaving long hair and/or short hair or stubble, as commonly found in men's beards and women's legs. In addition, with the ever increasing time constraints and commitments individuals typically encounter, a fast and effective shaving system is most desirable.

The discomfort as well as the time consumed in using shaving creams, soaps and gels, in order to provide a medium for which a razor can be used, requires more time and inconvenience than most individuals are willing or capable of experiencing. Furthermore, the cost of maintaining a sufficient supply of these products creates an additional burden. Consequently, electric dry shavers have become increasingly popular, as well as battery-operated electric dry shavers which can withstand exposure to moisture, thereby enabling individuals to simultaneously shower, as well as shaving their beard or legs.

As the popularity of using electric dry shavers increased, numerous product designs with alternate constructions proliferated, in an attempt to improve and enhance the comfort and cutting efficiency of such shavers. However, in spite of these products, difficulties have continued to exist in providing optimum results with optimum comfort and convenience.

The two principal shaver constructions that have been found to be extremely efficacious in achieving high-quality shaving results, as well as being extremely comfortable to use, are foil shavers and rotary shavers. These configurations comprise various models of electric dry shavers, with one incorporating a movable cutting blade which cooperates with a thin, flexible mesh screen or apertured foil. The second configuration employs a plurality of circular-shaped cutting blades, typically three, which cooperate with circular-shaped foil members.

In operation, the cutting blades are rapidly and continuously reciprocally or rotationally moved past one side of the mesh screen or apertured foil, causing the cutting blades to repeatedly cross the plurality of apertures and provide a virtually continuous cutting action at each aperture. Then, by slidingly guiding the other side of the mesh screen or apertured foil over the skin surface to be shaved, the individual hair shafts enter the holes formed in the screen or foil and are cut by the movement of the cutting blades.

Although these dry shaving cutting systems have proven to be extremely effective, as compared to other dry shaving products, one important area of difficulty does exist. This area of difficulty is found in the cleaning of the foil and cutting blades on a regular basis to assure optimum performance. In addition, the entire cutting chamber or hair pocket should be cleaned on a regular basis.

Since most individuals have extremely busy schedules, routine cleaning of the cutting blades, the cutting foils, and the cutting chamber or hair pocket are often ignored, resulting in the buildup of a large quantity of debris caused by the cut hair fibers. Eventually, this buildup of debris causes a degradation of the cutting efficacy.

In order to eliminate the need for individuals to manually clean the cutting blades, cutting foils, and hair pocket, prior art systems have been developed which provide an automated cleaning system. Although these prior art systems are generally capable of producing the desired cleaning effect, some prior art systems have been found to be extremely costly, due to the quantity of cleaning fluid required to achieve the desired cleaning result.

Although several prior art systems exist, one prior art cleaning system requires a holding chamber or cradle to be filled with cleaning fluid with the shaver being placed in the holding chamber or cradle in order to enable the cleaning fluid to fill the hair pocket of the shaver, covering the cutting blades and cutting foils. Then, by activating the cutting blades, the desired movement to the cleaning fluid through the hair pocket is achieved, causing a cleaning effect. After an appropriate time has lapsed, the fluid is drained from the chamber/cradle and the entire process repeated, if necessary.

Due to the requirement that a chamber/cradle must be filled with cleaning fluid in order to attain the desired exposure of the cleaning fluid to the cutting chamber, foils, and blades, a substantial quantity of cleaning fluid is required for each cleaning cycle. Furthermore, a separate and independent fluid holding cartridge is employed which also incorporates a filter. After several cleaning cycles, the cartridge must be replaced in its entirety, resulting in added costs to the consumer.

Consequently, it is a principal object to the present invention to provide a shaver construction and cleaning system therefore which completely eliminates the need for filling a chamber with cleaning fluid in order to achieve the desired cleaning result.

Another object of the present intention is to provide a shaver construction and cleaning system therefor having the characteristic features described above which is capable of fast, effective, and efficient cleaning of any desired shaver with a minimum of cost or expense.

Another object of the present intention is to provide a shaver construction and cleaning system therefor having the characteristic features described above wherein the cleaning fluid is delivered directly into the hair pocket or cutting chamber for optimum-performance.

Another object of the present intention is to provide a shaver construction and cleaning system therefor having the characteristic features described above wherein the delivery fluid is transmitted under pressure for enhanced effectiveness.

Other and more specific objects will in part be obvious and will in part appear hereinafter.

SUMMARY

By employing the present invention, all of the prior art difficulties and drawbacks have been completely eliminated and a substantially improved, fully integrated, shaving and cleaning system is obtained which is capable of providing automated cleaning of the shaver in an efficient and effective manner. Furthermore, by employing the present invention, the cleaning fluid is delivered directly to the interior of the shaver in a highly efficient manner, substantially enhancing the cleaning of the cutting blades, cutting foils, and hair pocket surfaces, while also substantially reducing the quantity of cleaning fluid required.

In accordance with the present invention, a shaver receiving and supporting housing is provided which is constructed for receiving and securely maintaining a shaver in an inverted or upside-down position. In addition, the housing is constructed for receiving and supporting rotary shavers and/or foil shavers. If desired, a universal housing is employed which is constructed for cooperating with both rotary shavers and foil shavers. Alternatively, separate housings are employed which are specifically constructed for receiving either a rotary shaver or a foil shaver.

In addition, the shaver receiving and supporting housing incorporates an enlarged basin or tub which is designed for enabling the shaver to be positioned and fully supported therein, completely independently of the basin or tub itself. Since the present invention completely eliminates the need for filling the basin or tub with the cleaning fluid, the basin or tub can be substantially greater in size and dimensions than the outer surface of the shaver itself. As result, the overall configuration of the basin or tub may be widely varied, without departing from the unique aspects and operational efficacy of the present invention.

Furthermore, the housing is constructed with a supporting member cooperatively associated with the basin/tub for enabling the shaver to be fully supported and maintained in the desired inverted position. In addition, the housing further comprises a reservoir, within which cleaning fluid is retained, and a cleaning fluid delivery pump which is cooperatively associated with the reservoir for drawing the cleaning fluid from the reservoir and delivering the fluid directly to the shaver.

In the preferred embodiment, the housing also incorporates filter means which is cooperatively associated with the fluid retaining reservoir, as well as the basin/tub. In this way, as is further detailed below, cleaning fluid exits the shaver after cleaning the cutting blades, hair pocket, and cutting foils, and is allowed to enter the basin, which is constructed to drain into the filter means. After passage through the filter means, any debris contained in the fluid is removed, and the filtered cleaning fluid is returned to the reservoir for re-use.

Finally, the preferred embodiment of the housing is completed by also incorporating a fan cooperatively associated with the basin/tub, for drawing ambient air through the fan and delivering the air to the shaver after cleaning. In this way, the cleaned cutting elements of the shaver are efficiently and effectively dried.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF THE DRAWINGS

By referring to FIGS. 1-17, along with the following detailed discussion, the preferred constructions and operations of the shaver cleaning systems of the present invention can best be understood. Although two preferred embodiments of the present invention are fully detailed in the following disclosure, and shown in the Figures, the present invention can be implemented in alternate configurations, without departing from the present invention. Consequently, it is to be understood that the following detailed disclosure, as well as the embodiments shown in FIGS. 1-17, are provided for exemplary purposes only and are not intended as a limitation of the present invention.

Figure 16:
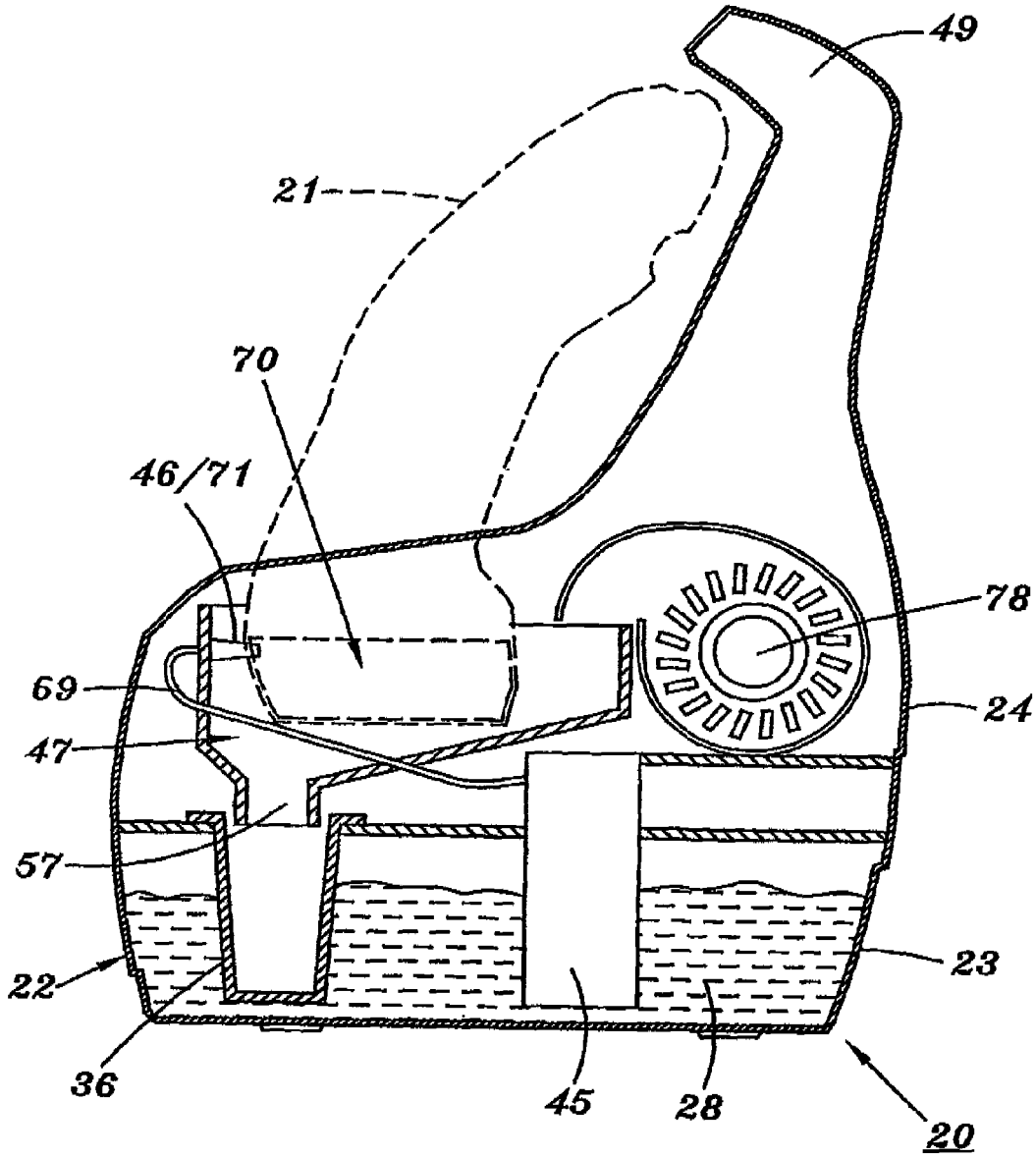
FIG. 16 is a cross-sectional, side elevation view of an alternate embodiment of the shaver cleaning system of the present invention.
Figure 17:
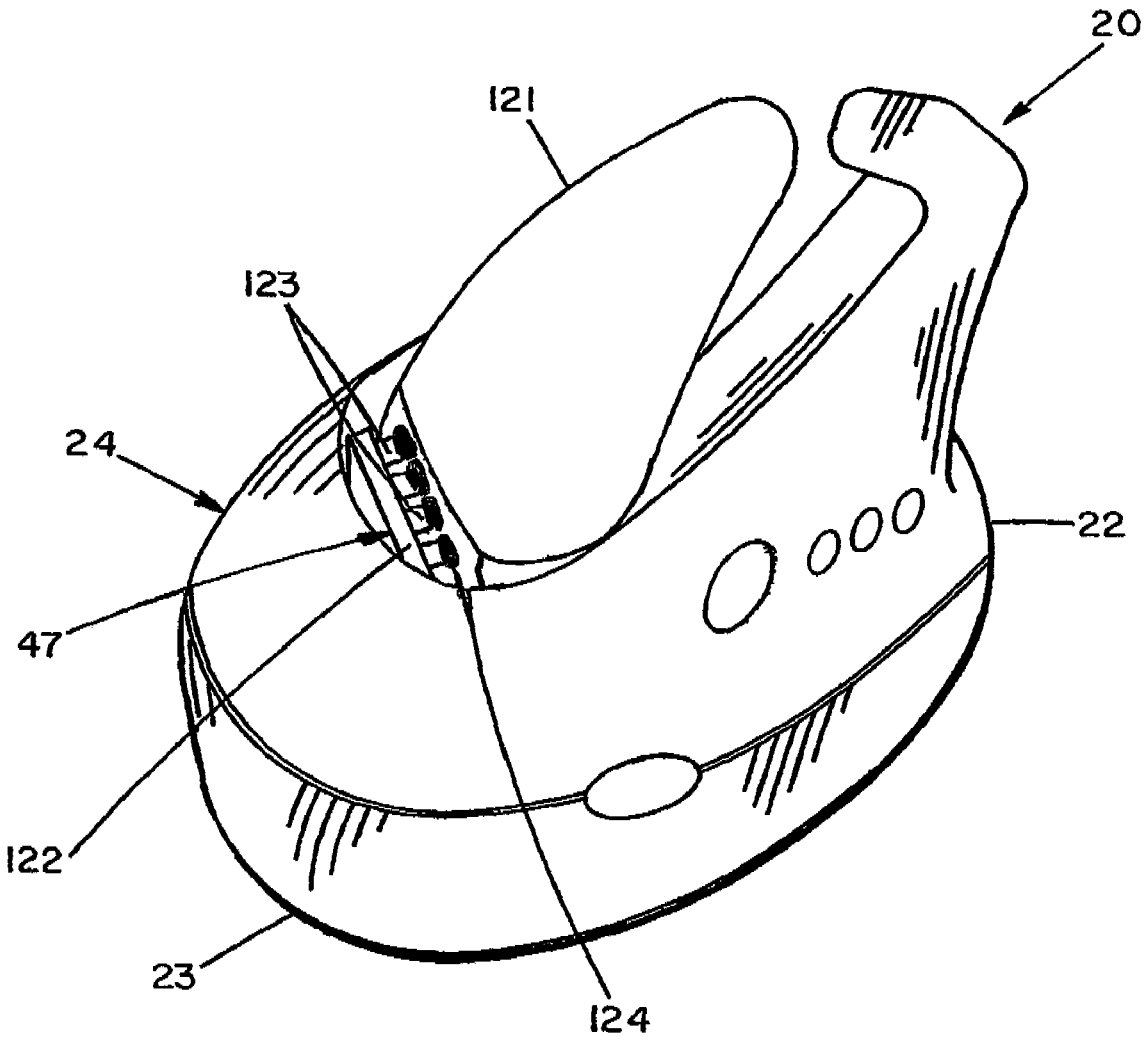
FIG. 17 is a perspective view of an alternate embodiment of the shaver cleaning system of the present invention with a foil shaver mounted in place.

In FIGS. 1-17, fully integrated, shaver cleaning system 20 of the present invention is depicted comprising housing 22 in association with a shaver. Furthermore, FIGS. 1-16 depict cleaning system 20 with shaver 21 comprising a rotary foil shaver, while FIG. 17 depicts cleaning system 20 constructed for shaver 121 as a foil shaver. As is detailed herein, whether the shaver comprises a rotary shaver or a foil shaver, cleaning system 20 of the present invention is capable of achieving a thorough and complete cleaning of the cutting blades, foils, and hair pocket thereof by delivering a pressurized flow of a cleaning fluid directly into the hair pocket of the shaver, thoroughly cleaning the blades, cutting foils and hair pocket surfaces prior to being drained therefrom. In this way, the desired cleaning of the shaver is achieved, regardless of the cutting system employed by the shaver.

As shown in FIGS. 1-16, cleaning system 20, as constructed for use with rotary shaver 21, incorporates housing 22 which is preferably constructed comprising base portion 23 and shaver holding portion 24. In the preferred construction, shaver holding portion 24 is removably mountable to base portion 23, and is capable of being easily telescopically inserted and securely latched to base portion 23. In addition, when desired, shaver portion 24 is quickly released from latched engagement with base portion 23 and removed, in its entirety, therefrom.

In the preferred construction, base portion 23 is formed by bottom surface 26 and upstanding wall 27, which peripherally surrounds and envelopes bottom surface 26. By employing this configuration, the interior of base portion 23 forms cleaning fluid retaining or holding zone 28.

The preferred construction of base portion 23 is completed by mounting panel or cover 29 to base portion 23 in juxtaposed, spaced, relationship to bottom surface 26. As depicted, panel/cover 29 incorporates enlarged aperture 30 formed therein, through which the desired cleaning fluid is easily poured for filling fluid retaining/holding zone 28.

In addition, panel/cover 29 also incorporates filter assembly receiving zone 31, and three alignment holes 33. As detailed below, alignment holes 33 are constructed for receiving engagement with post members 34 formed on shaver holding portion 24. Furthermore, receiving zone 31 may also be used for filing fluid retaining/holding zone 28, preferably when filter assembly 36 is removed.

In the preferred construction, filter assembly receiving zone 31 is peripherally surrounded by upstanding flange 35 which is constructed for mating holding engagement with filter assembly 36. As depicted and as further detailed below, filter assembly 36 incorporates filter holding plate 37 and filter member 38, preferably formed in a small bag configuration, which is securely affixed to filter holding plate 37. In addition, filter holding plate 37 incorporates an enlarged aperture 39 through which the cleaning fluid is directed after passage through shaver 21.

In accordance with the present invention, shaver holding portion 24 of housing 22 is constructed for supportingly retaining shaver 21 in an inverted position, and enabling the cleaning fluid retained in fluid retaining/holding zone 28 of base portion 23 to be withdrawn therefrom and delivered to shaver 21. As detailed below, in order to provide the desired controlled, pressurized, fluid flow, holding portion 24 incorporates pump assembly 45 and fluid delivery manifold 46, which is directly connected with pump assembly 45. In addition, shaver holding portion 24 also incorporates shaver receiving and holding basin 47, mounting plate 48 which forms the bottom surface of shaver holding portion 24, and shaver support column 49. Finally, the construction of shaver holding portion 24 is completed by outer surface defining shell or wall member 50.

In the preferred construction, mounting plate 48 incorporates three post members 34 which longitudinally extend from the bottom surface thereof and are positioned for cooperative telescopic interengagement with alignment holes 33 of panel/cover 29. In this way, shaver holding portion 24 is quickly and easily mounted in secure engagement with base portion 23 in order to form housing 22. By employing post members 34 and alignment holes 33, the precisely desired orientation and position of shaver holding portion 24 relative to base portion 23 is assured.

In order to enable shaver holding portion 24 to be quickly and easily removable from shaver portion 23, as well as quickly and easily mounted into secure locked engagement with base portion 23, when desired, shaver holding portion 24 incorporates two release buttons 51, formed on opposed sides of holding portion 24, with each release button 51 being constructed for controlling the movement of a cooperating spring biased latch 52. In addition, each latch 52 is aligned for cooperative locking engagement with one upstanding hook 53 formed on panel/cover 29 of base portion 23. By employing this construction, shaver holding portion 24 is quickly and easily aligned and positioned for engagement with base portion 23 by employing posts 34 and alignment holes 33 and, once so positioned, advanced into secure, locked engagement with each other by the automatic locking engagement of latches 52 with hooks 53.

In order to provide the desired controlled delivery of the cleaning fluid from fluid retaining/holding zone 28 to shaver 21, pump assembly 45 is employed. In the preferred construction, pump assembly 45 is mounted in housing 60 which is mounted in direct association with shaver receiving basin 47. In the preferred construction, housing 60 is mounted adjacent and below basin 47 for enabling pump assembly 45 to be easily inserted through receiving aperture 30 of panel/cover 29 when shaver holding portion 24 is a mounted to base portion 23. In addition, delivery tube 61 extends from housing 60 to fluid delivery manifold 46, for providing the desired flow of the cleaning fluid from retaining/holding zone 28 through pump assembly 45 and housing 60 through delivery tube 61 and into fluid delivery manifold 46.

Figure 1:
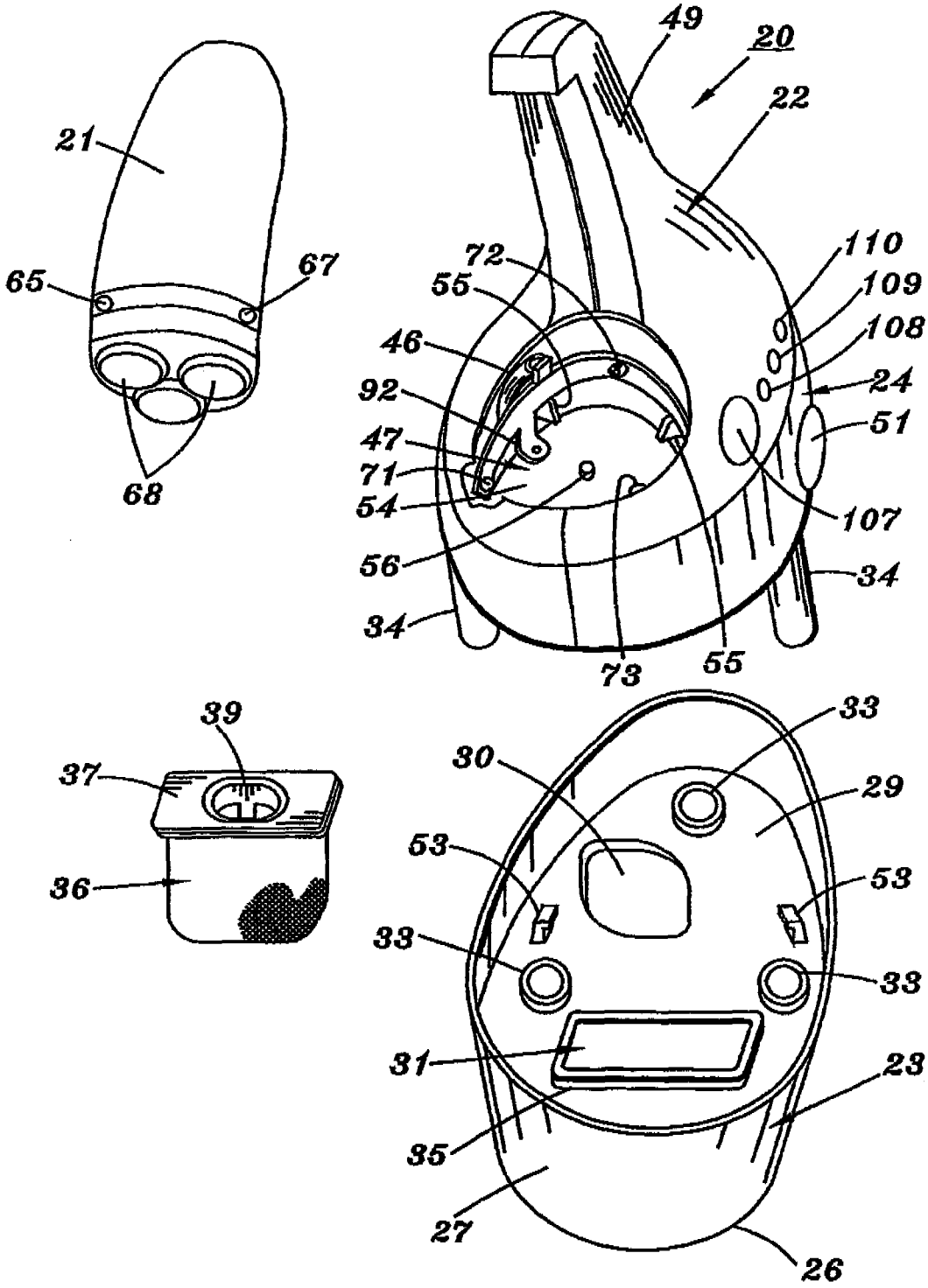
FIG. 1 is an exploded perspective view depicting the shaver cleaning system of the present invention, with a rotary shaver mounted therewith.
Figure 2:
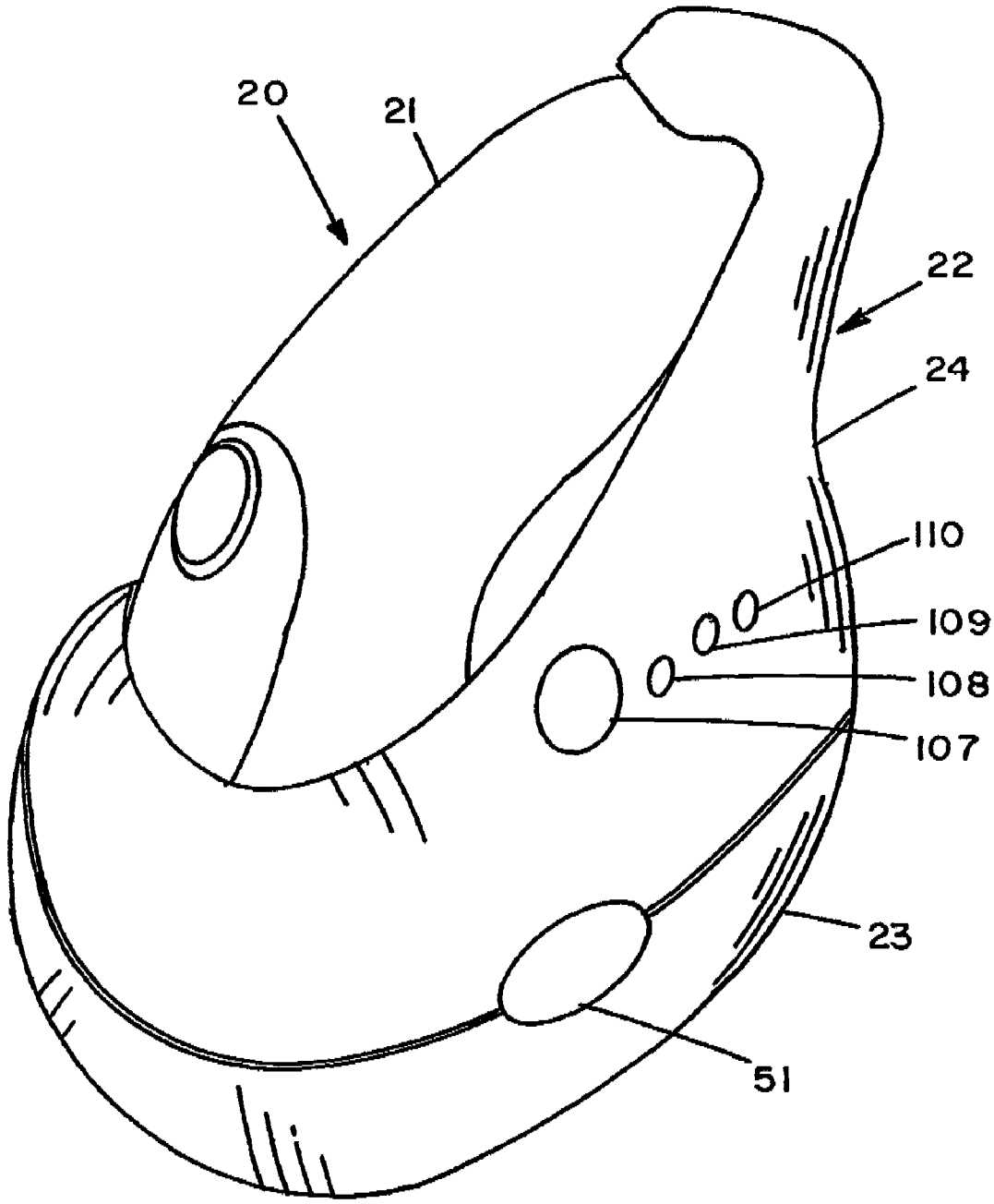
FIG. 2 is a perspective view of the shaver cleaning system of the present invention with a rotary shaver mounted in place.
Figure 4:
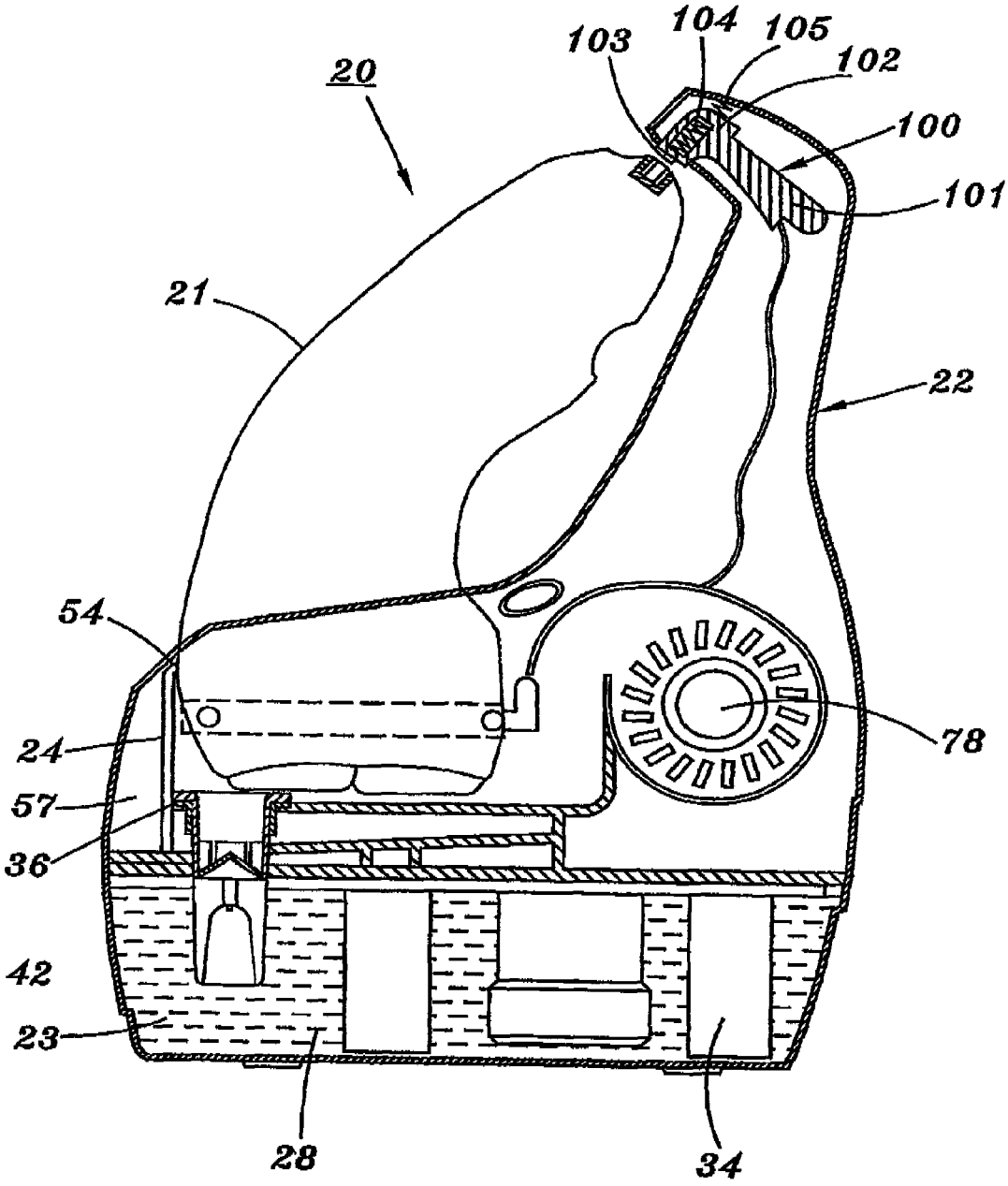
FIG. 4 is a cross-sectional side elevation view of the shaver cleaning system of the present invention with a rotary shaver mounted thereto.
Figure 5:
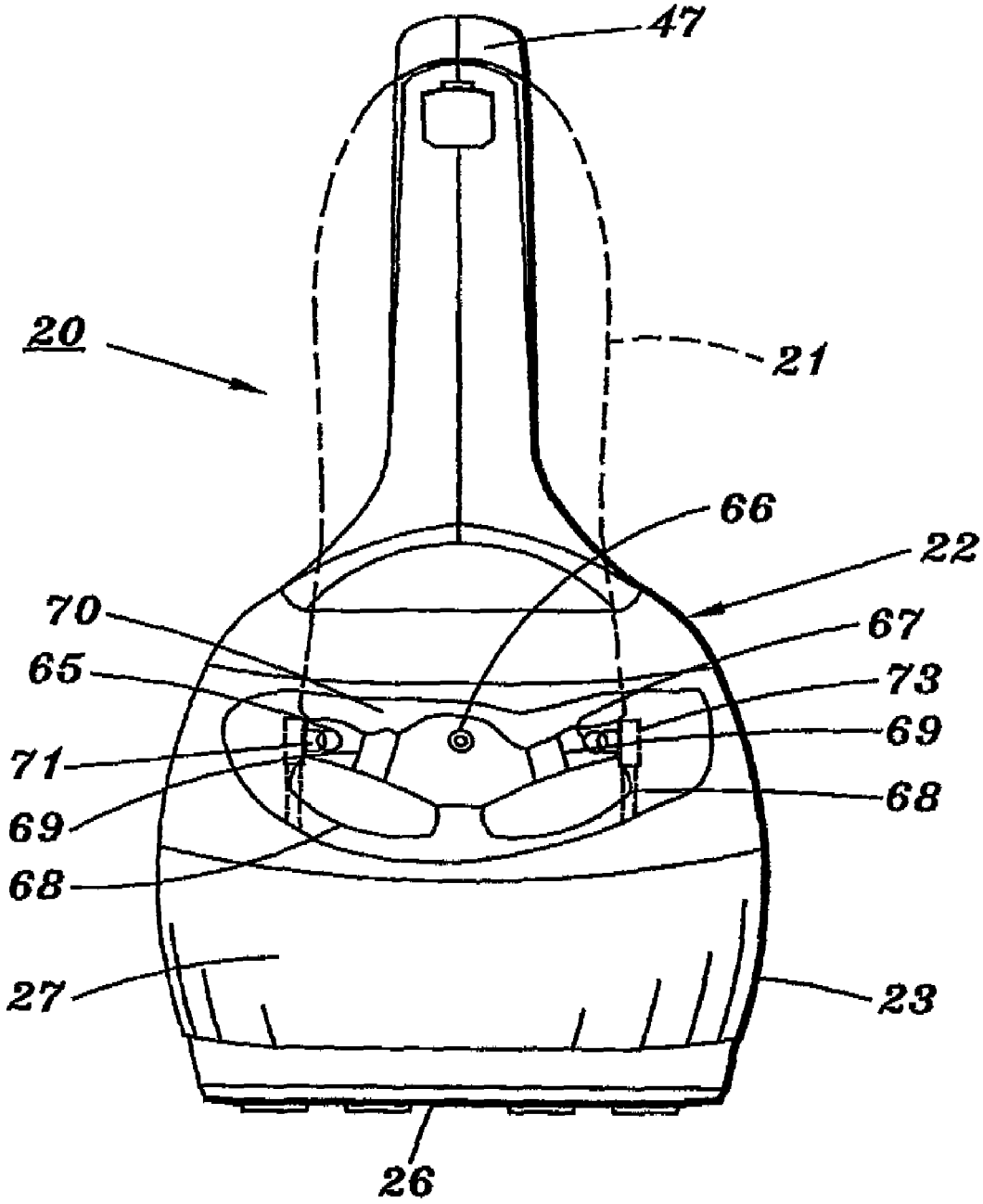
FIG. 5 is a front elevation view, partially in cross-section, depicting the shaver cleaning system of the present invention with a rotary shaver mounted thereto and shown partially in cross-section and partially in phantom.
Figure 6:
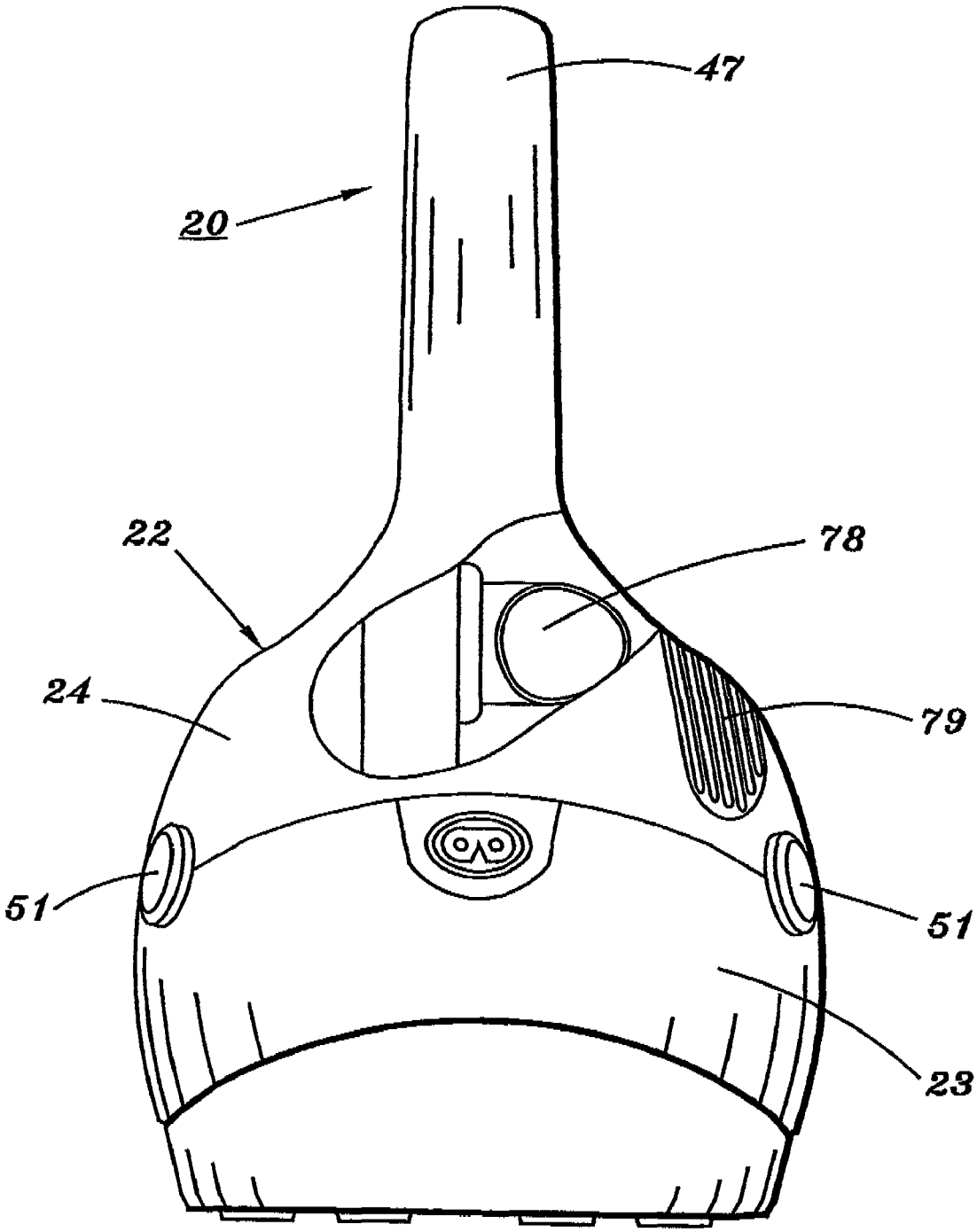
FIG. 6 is a rear elevation view, partially in cross-section, of the shaver cleaning system of the present invention.

As best seen in FIGS. 1, 4, and 5, shaver 21 incorporates a plurality of portals or passageways 65, 66, and 67 formed in the outer surface thereof, directly adjacent cutting foils 68. In the preferred construction, portals/passageways 65, 66, and 67 extend directly into hair pocket 70 of shaver 21, directly above cutting blade assemblies 69. Although the use of three separate and independent portals/passageways is detailed herein and has been found to provide the desired results, any desired number of portals/passageways can be employed without deviating from the scope of the present invention.

In order to enable shaver cleaning system 20 of the present invention to deliver the cleaning fluid directly into hair pocket 70 of shaver 21, fluid delivery manifold 46 incorporates nozzles 71, 72, and 73 integrally formed thereon and positioned for cooperative, aligned engagement with portals/passageways 65, 66, and 67 of shaver 21. As shown, whenever shaver 21 is inverted and positioned in shaver receiving basin 47, nozzle 71 is automatically aligned with through portal/passageway 65, while nozzle 72 is aligned with portal/passageway 66, with nozzle 73 being aligned with through portal/passageway 67. In this way, the cleaning fluid delivered to fluid delivery manifold 46 exits through nozzles 71, 72, and 73 directly to portals/passageways 65, 66, and 67 and into hair pocket 70 of shaver 21.

As is more fully discussed below, when cleaning system 20 is activated, the cleaning fluid is delivered under pressure, as exerted by pump assembly 45, forcing the cleaning fluid to rapidly enter hair pocket 70 of shaver 21 and be distributed throughout hair pocket 70. This action causes the cleaning fluid to forcibly enter hair pocket 70 in a turbulent, widely dispersed flow pattern, and contact cutting blade assemblies 68, cutting foils 69, and the surfaces of hair pocket 70. With the pressurized flow of the cleaning fluid entering hair pocket 70, rapidly filling the entire hair pocket and freely flowing throughout the hair pocket, the desired cleaning of all of the desired components and surfaces is achieved, in a manner which is similar to power washing of desired surfaces.

By employing shaver cleaning system 20 of the present invention, all of the debris contained within hair pocket 70 is exposed to the flushing action caused by the cleaning fluid forceably flowing throughout hair pocket 70, vigorously contacting cutting blade assemblies 69, the hair pocket surfaces, and cutting foils 68, driving all of the hair fiber debris off of these surfaces. Once passage of the fluid throughout hair pocket 70 is completed, the cleaning fluid drains directly through the cutting foils 68 into basin or tub 47.

Although the delivery of the pressurized cleaning fluid into hair pocket 70 has been found to provide effective cleaning of all debris, cutting blades 69 are preferably activated during the delivery of the cleaning fluid to further enhance the distribution of the cleaning fluid throughout the entire hair pocket 70. By activating the cutting blades 69, enhanced mixing of the fluid in hair pocket 70 is realized. Once sufficient time has elapsed to enable all of the desired cleaning to be achieved, the rotation of the cutting blades is stopped, and all of the remaining fluid contained in the hair pocket is allowed to flow through cutting foils 68 directly into basin 47.

Shaver receiving basin 47 is constructed to supportingly retain shaver 21 in the desired inverted position and receive the cleaning fluid as the cleaning fluid exits from hair pocket 70 of shaver 21. In addition, basin/tub 47 incorporates enlarged drain portal 57 formed therein, which is positioned in cooperating relationship with filter assembly 36. As depicted, drain portal 57 comprises an enlarged opening formed in basin 47. In this way, the cleaning fluid entering basin 47 is quickly delivered to filter assembly 36 through portal 57. By passing through filter assembly 36, all of the debris contained in the cleaning fluid is removed from the cleaning fluid, and the debris-free cleaning fluid is transferred through filter assembly 36 into holding zone 28 for reuse. In this way, the cleaning fluid is able to be effectively and efficiently used for an extended period of time.

Furthermore, in the preferred construction, the inlet of housing 60 of pump 45 incorporates a separate filter cover. In this way, any debris which may have entered the cleaning fluid is prevented from entering pump 45 and being delivered to manifold 45. As a result, possible clogging of nozzles 71, 72, and 73 is prevented.

In the present invention, basin 47 is constructed for merely receiving the cleaning fluid draining out of hair pocket 70 of shaver 21 and rapidly channeling the fluid into enlarged drain portal 75 for removal from basin 47. As a result, the particular size, shape, and/or overall configuration of basin 47 can be widely varied. Since basin 47 is not employed for receiving and holding cleaning fluid in order to enable the cleaning fluid to enter hair pocket 30, as is found in prior art systems, controlling the dimensions of basin 47 in order to reduce the quantity of cleaning fluid required while also enabling the fluid to enter the hair pocket is unnecessary in the present invention. In fact, such prior art constructions are counterproductive, since the present invention employs rapid removal and disbursement of the cleaning fluid from shaver 21 and basin 47 in order to optimize the cleaning operation.

As is evident from the foregoing detailed discussion, unique fluid delivery and cleaning system 20 of the present invention provides a highly effective, pressurized flushing action for delivering a vigorous, continuous flow of cleaning fluid directly to the soiled surfaces of a shaver, namely the cutting blades 69, the cutting foils 68, and the hair pocket 70. In addition, this flushing action causes the hair fiber debris to be quickly and efficiently dislodged from the surfaces on which the debris is retained. The debris carried in the cleaning fluid, is drained through cutting foils 68, and into the receiving basin 47, which then funnels the cleaning fluid into filter assembly 36 for removal of the debris from the cleaning fluid. Thereafter, the filtered cleaning fluid is returned to fluid holding zone 28.

By employing this unique construction, the pressurized flushing action is capable of specifically targeting the soiled sections of the shaver in a unique and efficient manner, enabling cleaning of the precisely desired surfaces to be achieved in a substantially reduced time period. In addition, the quantity or volume of fluid needed to achieve optimum cleaning of all of the desired components is substantially reduced and minimized, in view of the limited area of the hair pocket into which the cleaning fluid is directly fed and circulated. As result, a highly effective, efficient, and enhanced shaver cleaning system is attained.

The final principal component preferably incorporated into shaver cleaning system 20 of the present invention is fan assembly 78 which is positioned for drawing ambient air through portal 79 formed in wall 50 and feeding the ambient air directly to the outer surface of shaver 21. In this way, once the cleaning fluid has been circulated and drained from hair pocket 70, in the manner detailed above, fan assembly 78 is activated to deliver a stream of air to flow about the outer surface of shaver 21 in the area of cutting foils 68, in order to dry the outer surface of shaver 21 by advancing or enhancing the evaporation of any cleaning fluid retained thereon.

As detailed above, one of the principal features of the present invention is the high velocity, turbulent flushing action which is produced by the cleaning system of the present invention when the cleaning fluid is forced through delivery nozzles 71, 72, and 73 of fluid delivery manifold 46 directly into portals/passageways 65, 66, and 67 of shaver 21 which communicate directly with hair pocket 70 of the shaver being cleaned. By employing this construction, the cleaning fluid is forced under pressure to flow directly into hair pocket 70, in a high velocity, turbulent flow pattern, causing all of the surfaces of hair pocket 70, cutter assemblies 69, and cutting foils 68 mounted in the hair pocket 70 to be completely cleaned of all debris, in a manner which is similar to the power washing of surfaces. This power washing/cleaning and flushing action is further enhanced by the continuous drainage of the cleaning fluid through cutting blade assemblies 69 and cutting foils 68 of the shaver 21 and the rapid delivery of the drained cleaning fluid into filter assembly 36 before returning to the cleaning fluid retaining zone 28.

As discussed above, in order to achieve the desired high velocity, delivery of the cleaning fluid into hair pocket 70 of shaver 21, fluid delivery manifold 46 in combination with pump assembly 45 and delivery tube 69 comprise the principal components. In this regard, pump assembly 45 is positioned directly in fluid retaining holding zone 28 within which the desired cleaning fluid is stored. Once activated, the cleaning fluid is drawn through pump assembly 45 and forcibly delivered through tube 69 directly into manifold 46. With fluid delivery manifold 46 comprising nozzles 71, 72, and 73, as the only exits formed thereon, the cleaning fluid flows through nozzles 71, 72, and 73 directly into portals 65, 66, and 67 of the shaver 21. In this way, the desired delivery of the cleaning fluid directly into hair pocket 70 is achieved.

Figure 13:
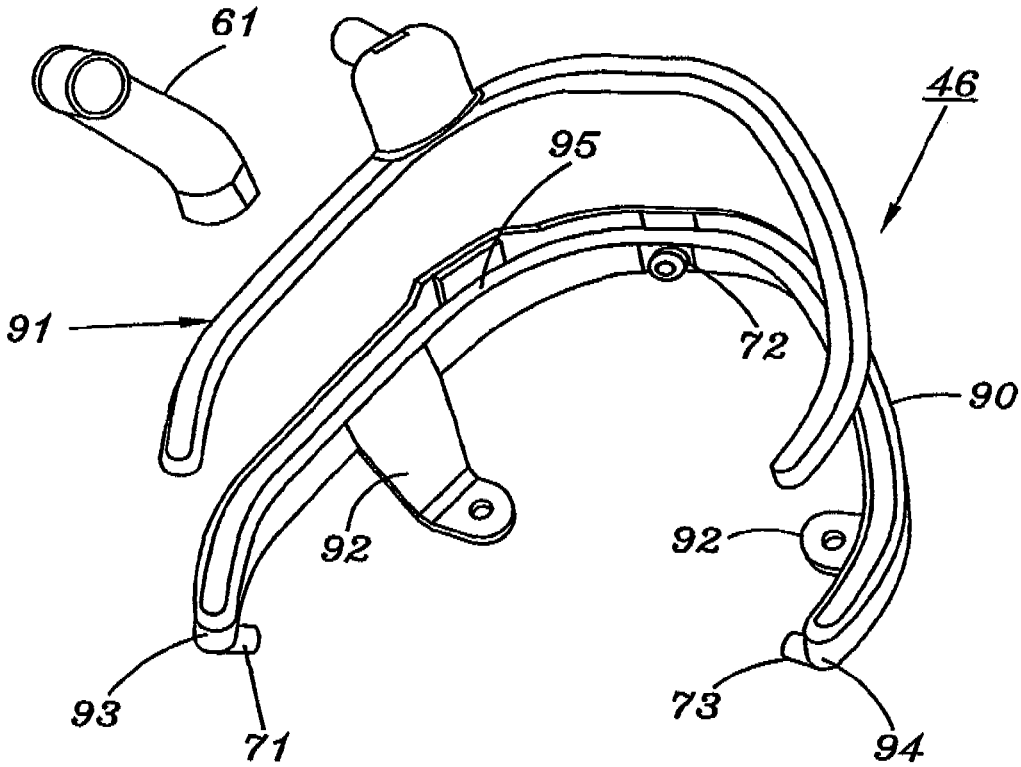
FIG. 13 is an exploded perspective view of the fluid delivery manifold employed in the shaver cleaning system of the present invention.

As best seen in FIGS. 1, 3, 4, 5, and 13, fluid delivery manifold 46 is constructed for peripherally surrounding the shaver 21, with nozzles 71, 72, and 73 aligned with portals 65, 66 and 67. In this way, assurance is provided that the cleaning fluid is fed directly into hair pocket 70. In its preferred construction, as shown in FIG. 13, fluid delivery manifold is formed in two pieces, base portion 90 and lid or cover 91 which is easily secured to base 90 for closing and sealing manifold 46, forming fluid flow channel 95. In this way, manifold 46 is easily constructed, as well as being easily assembled to provide a leak-free construction. Furthermore, base 90 incorporates legs 92 which enable the fully assembled manifold 46 to be quickly and easily securely mounted to basin 47.

As depicted, nozzles 71, 72, and 73 are formed with a rounded or arcuately curved outer surface for assisting in guiding and positioning each nozzle 71, 72, and 73 in the precisely desired aligned engagement with portals 65, 66, and 67 of shaver 21. In addition, in the preferred construction, fluid delivery manifold 46 is constructed in an overall U-shape, incorporating distal ends 93 and 94, both of which are constructed for being independently flexible relative to the central portion of manifold 46. In this way, shaver 21 is easily inserted into secure engagement with manifold 46, with assurance that nozzle 71, 72, and 73 will be aligned and easily positioned in peripheral surrounding, engagement with shaver 21 and portals 65, 66 and 67 thereof.

As depicted and detailed above, fluid delivery manifold 46 preferably comprises three separate and independent nozzles 71, 72, and 73 which are constructed for cooperating, aligned interengagement with portals 65, 66, and 67 of shaver 21. However, if desired, any desired number of nozzles and portals can be employed without departing from the scope of the present invention. In fact, if desired, as shown in FIG. 16, a single delivery nozzle can be used to deliver the cleaning fluid into hair pocket 70, and still achieve the desired results. Although three separate and independent nozzles and portals have been found to provide optimum results, any alternate quantity of nozzles and portals can be employed with equal efficacy.

In order to assure the precisely desired positioning of shaver 21 relative to manifold 46, shaver receiving basin 47 incorporates a plurality of upstanding ribs 55 integrally affixed to bottom surface 54 thereof. Ribs 55 incorporate a sloping, contoured edge and are positioned to assure receipt and placement of shaver 21 in the precisely desired location and orientation for assuring aligned cooperative engagement of portals 65, 66, and 67 of shaver 21 with nozzles 71, 72, and 73 of manifold 46. In addition, upstanding boss 56 is formed on bottom surface 54 of basin 47, with boss 56 being positioned for engaging the top surface of shaver 21 and providing further assistance in maintaining shaver 21 in the precisely required position for aligning portals 65, 66, and 67 with nozzles 71, 72, and 73.

In addition, as shown in FIG. 4, bottom surface 54 of shaver receiving basin 47 comprises a sloped configuration with the lowermost portion thereof being enlarged portal 57. In this way, all of the cleaning fluid draining from shaver 21 onto bottom surface 54 is controllably directed to quickly flow into portal 57 for rapid removal from basin 47 through filter assembly 36.

In operating cleaning system 20 of the present invention, it has been found that thorough and complete cleaning and removal of all debris from hair pocket 70 of shaver 21 is realized. In some instances, however, hair debris may be deposited on the outer surface of the circular shaped cutting foil assembly. In this regard, it has been found that by vertically displacing cutting foils 68 relative to the foils holding head of shaver 21, the gap or spacing between foils 68 and the head of shaver 21 is increased. This increased gap enables the cleaning fluid to pass between the head of the shaver and the outer ring of each cutting foil 68, and flush any retained debris away.

Figure 3:
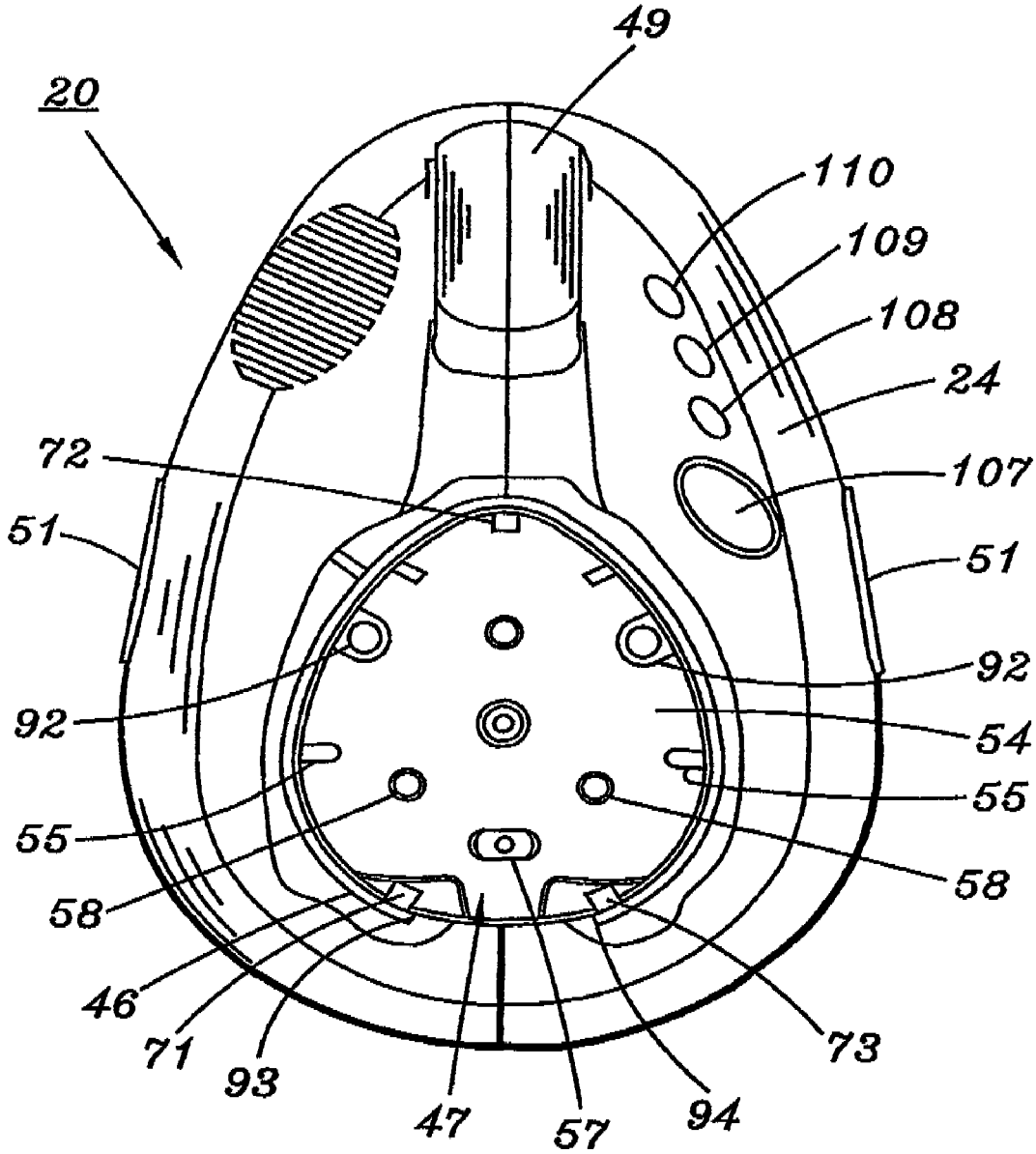
FIG. 3 is a top plan end view, partially broken away, depicting the shaver cleaning system of the present invention.

If the additional flushing action is desired, upstanding bosses 58, shown in FIG. 3, could be employed. As depicted, each boss 58 is aligned with one cutting foil 68, forcing the cutting foil assembly upwardly into shaver 21. In this way, the gap surrounding each cutting foil 68 is increased, enabling the cleaning fluid to flow between the head of the shaver and each cutting foil retaining ring, flushing any debris away.

Figure 14:
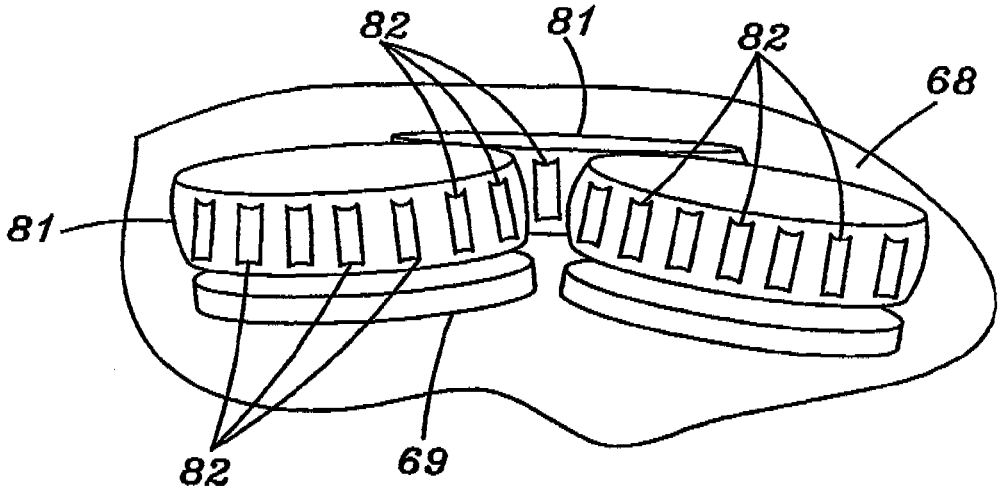
FIG. 14 is a side elevation view of an alternate embodiment for a cutting foil and cutting blade subassembly of a rotary shaver employed with the shaver cleaning system of the present invention.
Figure 15:
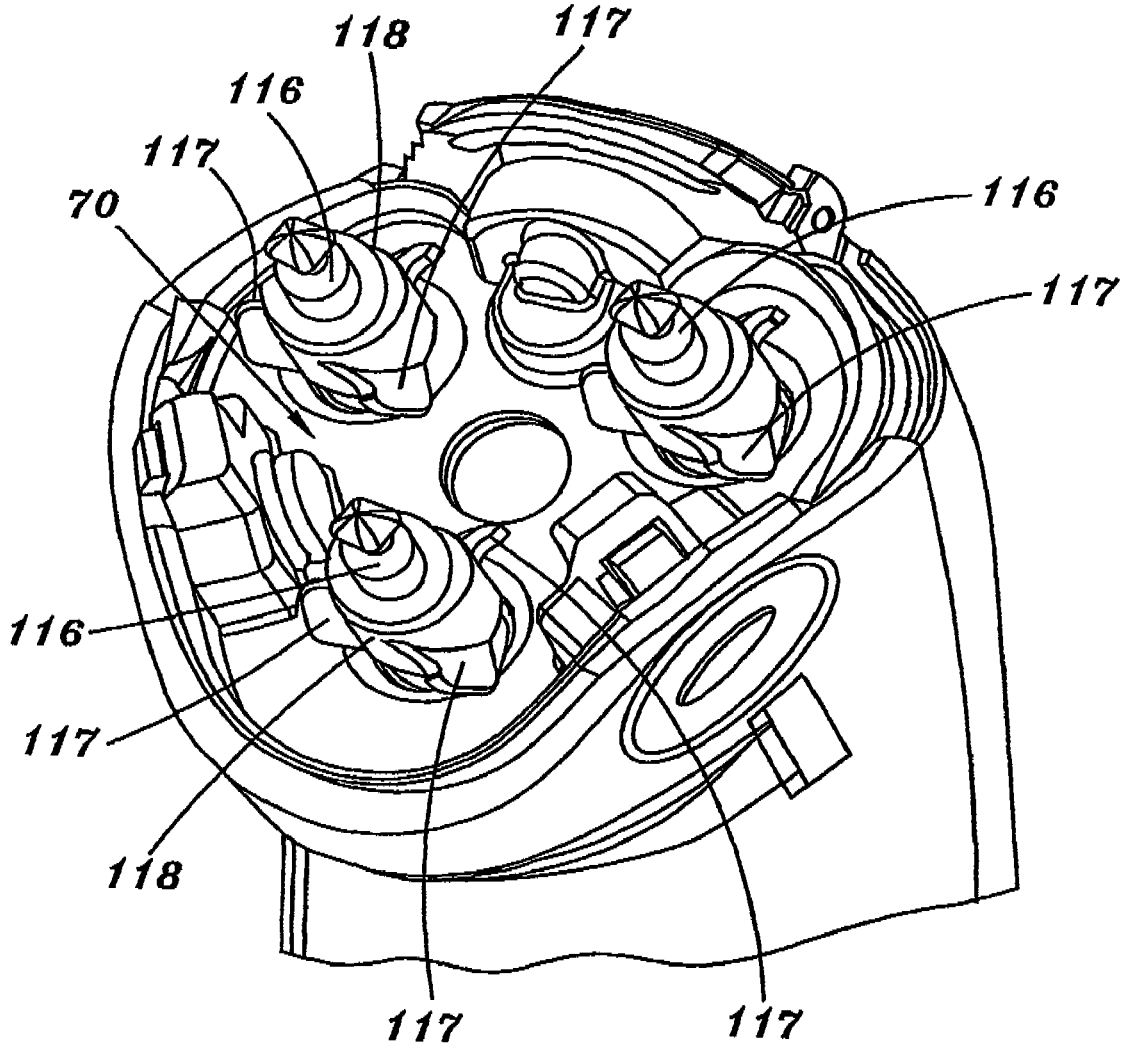
FIG. 15 is a top perspective view depicting an alternate embodiment for the rotating drive shafts employed in a rotary shaver employed in the shaver cleaning system of the present invention.

In FIG. 14, an alternate construction is depicted for enabling the cleaning fluid to flush debris off of the foil ring. In this embodiment, each cutting foil 68 is peripherally surrounded by a specially configured retaining ring 81. As shown, each retaining ring 81 incorporates a plurality of recesses or knurled zones 82 formed thereon. By forming a plurality of recesses or knurled zones 82 peripherally surrounding each retaining ring 81 of each cutting foil 68, a plurality of openings or flow paths are created which enable the cleaning fluid to pass more freely therethrough. As a result, the desired debris flushing flow is achieved. Furthermore, by configuring each recess or knurled zones 82 with a particular contour, a precisely desired rate of flow can be attained.

In order to enhance and assure the free flow of the cleaning fluid from basin 47 after the cleaning fluid drains from shaver 21, filter assembly 36 comprises a unique construction. In this regard, it has been found that prior art constructions result in filter systems which are prone to clogging more rapidly than expected, causing the filter system to require changing more rapidly than anticipated. In addition, the filter clogging also causes the cleaning fluid level to rise in the fluid holding zone or fluid container, resulting in cleaning fluid leakage therefrom. By employing the filter assembly of the present invention, all of these difficulties and drawbacks are completely eliminated.

Figure 12:
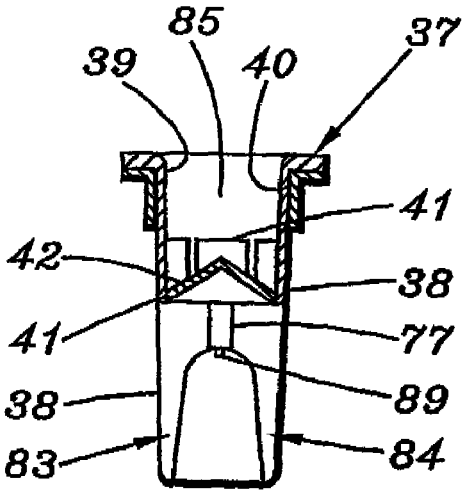
FIG. 12 is a side elevation view, partially in cross-section, of the filter assembly of FIG. 11.

As clearly shown in FIGS. 1, 4, and 12, filter assembly 36 preferably comprises filter member 38 which is configured in a bag shape, incorporating a single entry zone 85. In addition, filter assembly 36 incorporates holding plate 37 and mounting collar 40 which is constructed for peripherally surrounding and securely maintaining holding plate 37 and filter member 38 in the desired fully assembled configuration. In the preferred construction, entry zone 85 of filter member 38 is mounted peripherally surrounding pending flange 86 of holding plate 37. Once in position, collar 40 is securely mounted to plate 37, peripherally surrounding and securely engaging holding plate 37, with filter member 38 frictionally sandwiched between flange 86 of holding plate 37 and the cooperating wall member of collar 40. In the preferred embodiment, this construction forms the fully assembled filter member 36, which is replaced in its entirety, whenever filter member 36 needs to be changed.

In order to provide the desired free flow of the cleaning fluid into filter assembly 36, while also preventing clogging of filter bag 38 as the cleaning fluid enters filter assembly 36, holding plate 37 is constructed with a unique built-in diffuser system. As best seen in FIGS. 4 and 12, holding plate 37 incorporates aperture 39 formed on the top surface thereof, while also incorporating support posts 41 which peripherally surround aperture 39 and extend downwardly therefrom. In addition, diffuser plate 42 is mounted to holding plate 37, extending between posts 41 and incorporating an upwardly extending, generally inverted V-shape.

By employing this construction, the cleaning fluid passes rapidly through aperture 39 and contacts V-shaped diffuser plate 42. Due to the sloped angle provided by inverted V-shaped diffuser plate 42, the cleaning fluid contacts diffuser plate 42 and is diverted away from diffuser plate 42 towards support posts 41. Since support posts 41 are widely spaced from each other, forming open zones therebetween, the cleaning fluid freely passes between support posts 41 into filter member 38. In this way, all of the incoming cleaning fluid and the debris carried therein which is flushed from shaver 21 is gently dispersed towards the upper area of filter 38. As a result, the cleaning fluid quickly passes through filter 38, while the debris is retained within bag shaped filter member 38, slowly falling, by gravity, from the upper portion thereof to the bottom.

Figure 11:
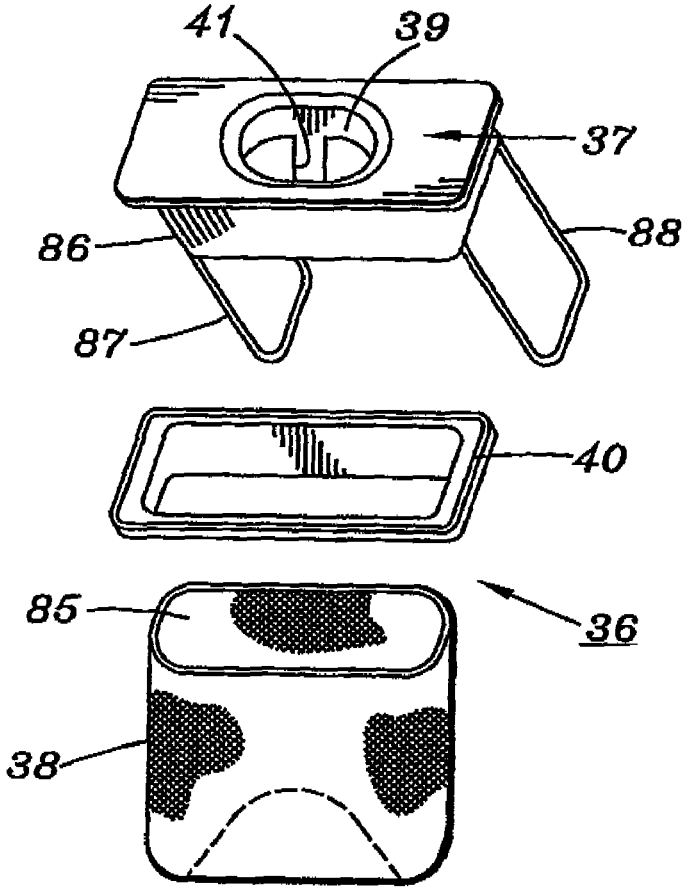
FIG. 11 is an exploded perspective view of the filter assembly employed in the shaver cleaning system of the present invention.

In order to further enhance the filtration of the hair debris from the cleaning fluid and provide a long lasting filter assembly construction, the base of filter member 38 is preferably formed into an inverted U-shape, as shown in FIGS. 4, 11 and 12. By employing the construction depicted, filter member 38 is formed into two separate lower zones 83 and 84, which effectively increases the available filtration area.

In order to attain the desired filter configuration, filter holding plate 37 incorporates two rectangular shaped wire frame members 87 and 88 affixed to the side edges of plate 37. By employing wire frame members 87 and 88, filter member 38 is shaped into the desired configuration defining both vertical side walls thereof.

In addition, filter holding bar 89 is mounted to the outside bottom end of filter member 38 and affixed to connecting plate 77, which extends below diffuser 42. In this way, the desired inverted U-shape is imported to filter member 38 and is maintained throughout the useful life of filter assembly 36.

Furthermore, by employing this construction, the debris originally captured on the upper surfaces of filter member 38 falls into either zone 83 or zone 84. As a result, the hair debris is split into two separate and independent areas in an easily achieved manner. Furthermore, by employing this construction in combination with diverter plate 42, the receipt and filtration of the debris is controlled and premature filter clogging is avoided.

It has been found that by eliminating a forceful stream of liquid directed straight downwardly towards the base of the filter member, filter clogging is eliminated. Generally, whenever a stream of cleaning fluid forcefully contacts the debris collected in the base of the filter bag, the debris tends to be kicked up, causing clogging of the filter. By employing the present invention, this prior art difficulty is eliminated. Furthermore, as detailed below, the present invention preferably employs a plurality of timed cycles for optimum cleaning of shaver 21, which further improve the handling and distribution of the debris in filter bag 38.

In accordance with the present invention, another unique aspect provided by shaver cleaning system 20 is the control system employed to clean and dry shaver 21, and the rapid, easy, and simple engagement provided for controllably mounting shaver 21 to housing 22. In regard to the controlled engagement of shaver 21 in housing 22, the present invention enables cleaning system 20 to gain complete operational control of shaver 21 whenever the user simply inserts shaver 21, in its inverted position, into housing 22.

As fully detailed above, the head or cutting portion of shaver 21 is mounted in shaver receiving basin 47 with the nozzles of fluid delivery manifold 46 perfectly aligned with the portals of shaver 21. In addition, by arcuately pivoting shaver 21 rearwardly towards shaver support column 49 of housing 22, the electrical contact pins formed in shaver 21 are automatically engaged with the cooperating contacts formed in shaver support column 49.

Figure 7:
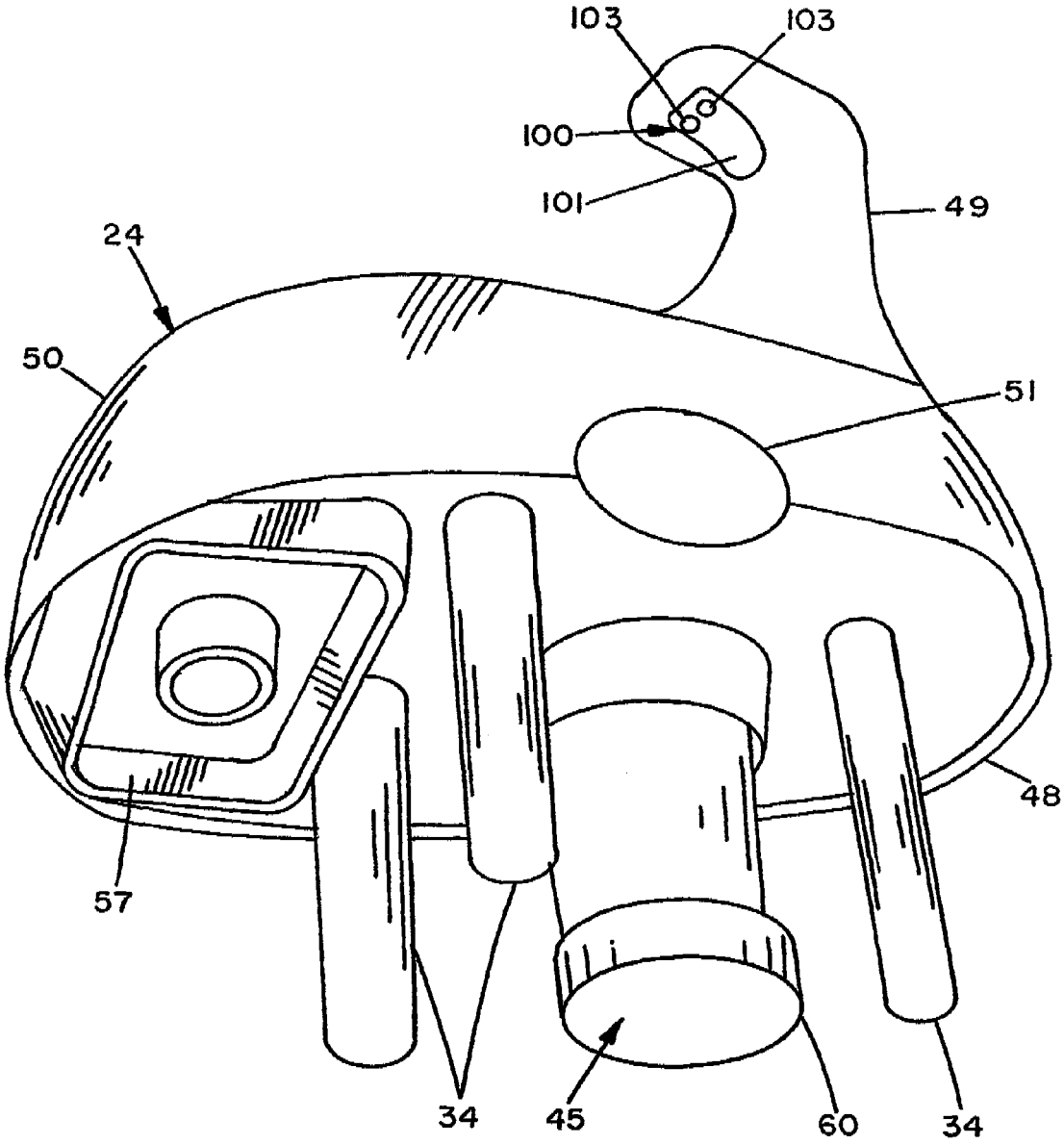
FIG. 7 is a bottom perspective view of the shaver holding portion of the shaver cleaning system of the present invention.
Figure 8:
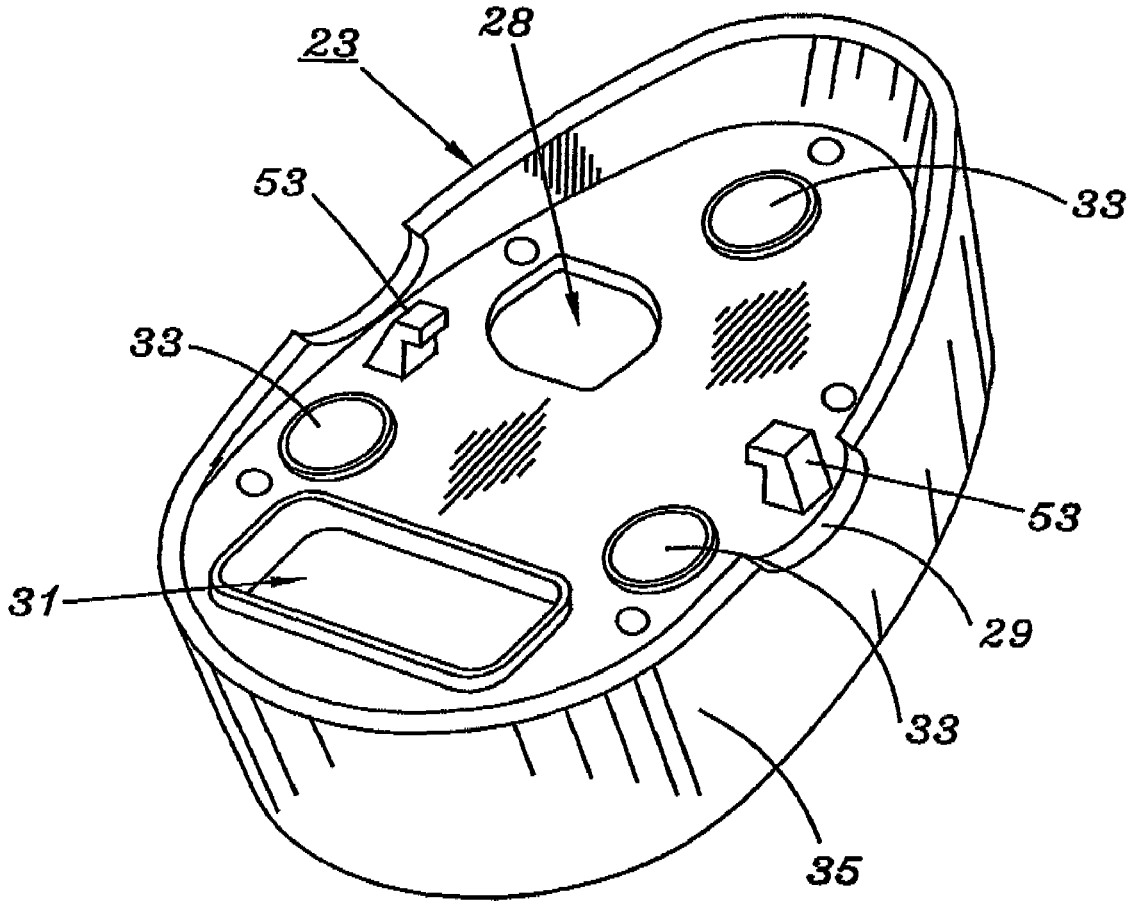
FIG. 8 is a top perspective view of the base portion of the shaver cleaning system of the present invention.
Figure 9:
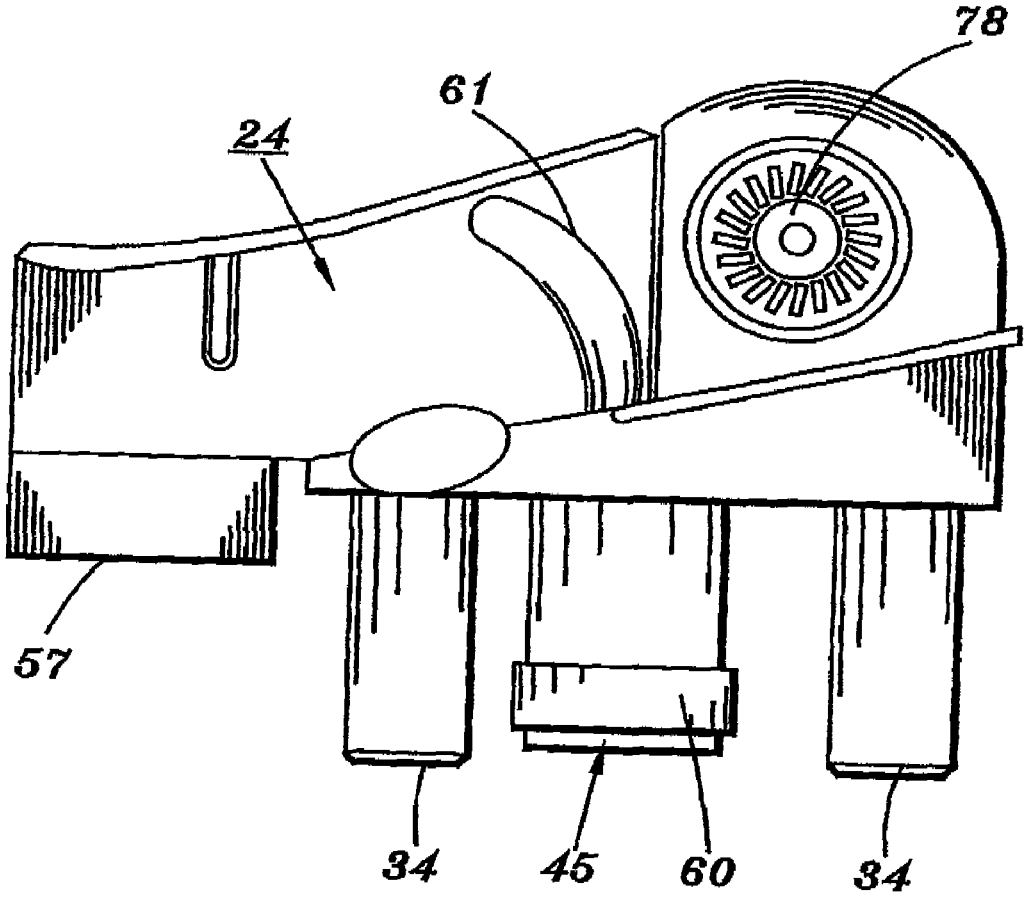
FIG. 9 is a left side elevation view of the shaver holding portion of the shaver cleaning system of the present invention with the outer walls thereof removed.
Figure 10:
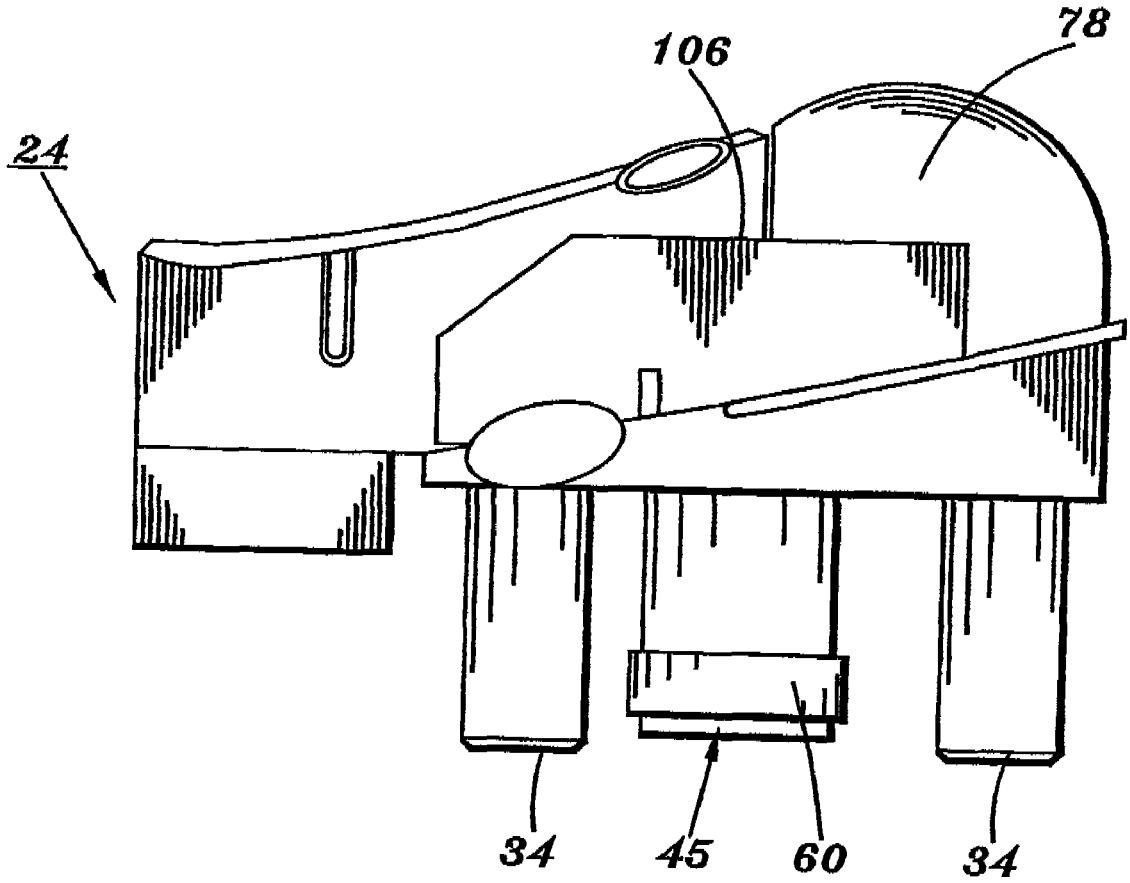
FIG. 10 is a right side elevation view of the shaver holding portion of the shaver cleaning system of the present invention with the outer walls thereof removed.

As best seen in FIGS. 4 and 7, contact assembly 100 incorporates support arm 101 which is pivotally mounted in shaver support column 49. In addition, coil spring 102 is controllably engaged with support arm 101 to bias support arm downwardly. Furthermore, the construction of contact assembly 100 is completed by mounting two pins 103 in receiving zones formed in support arm 101 with each pin 103 being spring biased downwardly by coil springs 104.

By employing this construction, shaver 21 is quickly and easily electrically connected to housing 22 by merely sliding shaver 21 into engagement with contact assembly 100. As typically found in most shaver constructions, shaver 21 incorporates pin members mounted at the base thereof which are employed for enabling electrical current to be delivered to shaver 21. In the present invention, when shaver 21 is mounted in basin 47 and arcuately pivoted rearwardly, the connection pins formed in the base thereof are brought into automatic electrical engagement with pins 103 of contact assembly 100.

By constructing contact assembly 100 in the mannered detailed above, support arm 101 flexes upwardly as shaver 21 is pivoted into position. Thereafter, support arm 101 is biased downwardly by coil spring 102 to cause pins 103 to electrically engage the contact of shaver 21. The desired electrical contact is further assured by incorporating coil springs 104 with pins 103, thereby causing pins 103 to be continuously biased downwardly, into secure electrical engagement with the pin contacts of shaver 21. In addition, since each pin 103 is separately spring biased, the desired contact with the connection pins of the shaver is assured, regardless of the vertical height each connection pin may have.

In order to enable cleaning system 20 to provide all of the requisite functions to enable shaver 21 to be fully and completely cleaned, when desired, as well as recharged to optimum operational levels, cleaning system 20 incorporates integrated circuit 106. Integrated circuit 106 is positioned within outer wall or shell 50 of shaver holding portion 24 and is interconnected with activation button 107 and LEDs 108, 109, and 110.

Although cleaning system 20 may be constructed with a wide variety of alternate operational systems, the preferred embodiment of the present invention employs integrated circuit 106 to automatically deliver a charging current to shaver 21 whenever shaver 21 is mounted to housing 22. In addition, in order to provide the user with visual confirmation that shaver 21 is being charged, LED 109 is illuminated whenever a charging current is delivered to shaver 21. In the preferred construction, LED 109 is maintained ON during the charging cycle, and is then either extinguished or changed to a blinking display, when shaver 21 is fully charged.

In addition, instead of automatically cleaning shaver 21 each and every time shaver 21 is mounted to housing 22, cleaning system 20 is constructed with the cleaning cycle being initiated by the user. In order to achieve this result, activation button 107 is employed. Once button 107 is pressed by the user, integrated circuit 106 activates the cleaning cycle, and automatically initiates the precisely desired timed sequential operational steps which have been found to produce optimum cleaning of shaver 21. In addition, LED 110 is illuminated whenever the cleaning cycle is initiated and, upon completion of the cleaning cycle, LED 110 is extinguished. In order to further enhance the ease of use of cleaning system 20 by the consumer, LED 108 is illuminated whenever the cleaning fluid in holding zone 28 needs to be replaced or replenished.

In order to assure that shaver 20 is thoroughly and completely cleaned of all debris in an efficient and trouble-free manner, substantial effort was expended in determining the optimum cycles that should be employed as well as time duration for each cycle. In Table I, the optimum cyclical operation for cleaning system 20 is detailed, along with the range of preferred elapsed time for each cycle. Furthermore, in Table II, the preferred specific cyclical operation for cleaning system 20 is detailed.

TABLE I

Cleaning Cycles

| Pump | Shaver | Fan | Elapsed Time |
|---|---|---|---|
| ON | ON | OFF | 5-15 seconds |
| OFF | ON | OFF | 2-7 seconds |
| ON | ON | OFF | 2-7 seconds |
| OFF | ON | OFF | 2-7 seconds |
| ON | ON | OFF | 1-4 minutes |
| OFF | ON | ON | 1-4 minutes |
| OFF | OFF | ON | 15-22 minutes |

TABLE II

Preferred Cleaning Cycles

| Pump | Shaver | Fan | Elapsed Time |
|---|---|---|---|
| ON | ON | OFF | 10 seconds |
| OFF | ON | OFF | 5 seconds |
| ON | ON | OFF | 5 seconds |
| OFF | ON | OFF | 5 seconds |
| ON | ON | OFF | 10 seconds |
| OFF | ON | OFF | 5 seconds |
| ON | ON | OFF | 10 seconds |
| OFF | ON | OFF | 5 seconds |
| ON | ON | OFF | 10 seconds |
| OFF | ON | OFF | 5 seconds |
| ON | ON | OFF | 10 seconds |
| OFF | ON | OFF | 5 seconds |
| ON | ON | OFF | 60 seconds |
| OFF | OFF | OFF | 60 seconds |
| OFF | ON | ON | 15 seconds |
| OFF | OFF | ON | 19 minutes |

As is evident from a review of Table I and Table II, optimum cleaning of shaver 21 is achieved by cycling pump assembly 45 in an ON and OFF mode for two cycles, ranging in total between about 11 and 36 seconds. This is followed by a third ON/OFF cycle ranging between about 2 and 8 minutes. During each of these cycles, the shaver preferably remains ON, in order to assure that the cleaning fluid is fully distributed throughout the hair pocket. In the final cycle, the pump is turned OFF, the shaver is turned OFF, and the fan is turned ON in order to dry shaver 21. As shown in Table I, the fan remains ON for between about 15 and 22 minutes.

Although the preferred operational system employs two separate cycles wherein the pump is first turned ON and then turned OFF for time durations ranging between about 2 to 15 seconds, it has been found that, if desired, a total of six similar cycles can be employed if additional cleaning is required. However, it has been found that the two cycles detailed in Table I provide effective and efficient thorough cleaning of shaver 21.

By employing two cycles wherein pump assembly 45 is cycled ON and then OFF, with shaver 21 remaining in the ON mode, an initial cleaning of the heavy debris contained in hair pocket 70 of shaver 21 is achieved. Then, by employing a third cycle which continues for between about 2 and 8 minutes, all of the remaining debris contained in hair pocket 70 of shaver 21 is eliminated. When both the pump assembly and shaver are in the OFF mode, fan assembly 78 is placed in the ON mode, unless already ON as shown in Table I. Preferably, the fan cycle continues for between about 15 and 22 minutes in order to thoroughly and completely dry all of the components contained in the cutting head of shaver 21.

In addition to providing complete and thorough cleaning of shaver 21, the cleaning cycles detailed above also provide self-cleaning of filter assembly 36. By employing the plurality of cycles detailed above, with varying time durations, in combination with the diverter plate incorporated in filter assembly 36, the debris which is initially deposited on the upper portion of filter member 38 is able to drop towards the bottom by gravity, as well as being continuously flushed off of the upper surface by the flow of the cleaning fluid during subsequent cycles. In this way, prior art clogging of a filter component is eliminated and the long term, efficient and effective operational use of filter assembly 36 is attained.

By employing the present invention, it has been found that thorough and complete cleaning of shaver 21 is attained in an easily employed, fast and efficient manner. Although the construction of the present invention, as detailed above, has proven its ability to achieve the desired cleaning of substantially all debris contained in shaver 21 after normal use, it has also been found that under certain operational circumstances, increased turbulence of the cleaning fluid in hair pocket 70 could assist in the cleaning operation. In order to provide this increased turbulence, the alternate embodiment shown in FIG. 15 may be employed.

As depicted, shaver 21 incorporates three separate and independent rotating drive shafts 116, each of which is constructed for rotationally driving a circular-shaped cutting blade 69 of shaver 21 in the normal manner found in all shaver constructions. However, in this embodiment, as depicted, radially extending arm or paddles 117 are mounted to each drive shaft 116 and constructed for extending substantially perpendicularly therefrom. In the preferred construction, paddles 117 extend from collar 118 which is affixed to shaft 116.

By incorporating arms or paddles 117 on each drive shaft 116 of shaver 21, the cleaning fluid flowing through hair pocket 70 is brought into contact with the plurality of arms/paddles 117, as arm/paddles 117 are rotating about the axis of shaft 116. The repeated engagement of the cleaning fluid with arms/paddles 117 causes the cleaning fluid to experience substantially increased turbulence, distributing the cleaning fluid in alternate patterns and flow paths for enhancing the cleaning of the surfaces of hair pocket 70, as well as cutting blade assemblies 69 and cutting foils 68. Consequently, if desired, arms/paddles 117 may be employed for providing increased turbulence to the cleaning fluid during the cleaning operation.

In the detailed disclosure provided above, one preferred embodiment of shaver cleaning system 20 has been fully and completely disclosed. In this embodiment, shaver cleaning system 20 is constructed for thoroughly and completely cleaning all of the debris contained in the hair pocket of rotary blade shaver 21. In addition to this embodiment, shaver cleaning system 20 of the present invention can also be constructed for thoroughly and completely cleaning foil shaver 121. As is well known, a foil shaver commonly refers to any electric shaver having one or more elongated, arcuately curved foil members forming the skin contacting surface, with the foil members cooperating with one or more cutters movably mounted in the shaver which typically comprise a plurality of flat cutting blades mounted on a long shaft. By referring to FIG. 17, along with the following detailed discussion, the preferred construction of this alternate embodiment for shaver cleaning system 20 can best be understood.

In this embodiment, shaver cleaning system 20 incorporates housing 22 which is formed by base portion 23 and shaver holding portion 24. In addition, except for the specific components detailed herein, all of the remaining components employed in this alternate embodiment are substantially identical to the components employed in the construction detailed above. As a result, identical reference numerals are employed herein for referring to identical components.

Furthermore, although foil shaver 121 is depicted as comprising three separate and independent arcuately curved foil members, each of which incorporate a separate and independent cutting blade assembly, any foil shaver construction is capable of enjoying the benefit of cleaning system 20. Consequently, it should be understood that foil shaver 121 depicted herein is provided for exemplary purposes only, and is not intended as a limitation of the present invention.

In the preferred construction of this embodiment of the present invention, shaver holding portion 24 of housing 22 incorporates shaver receiving basin 47 within which foil shaver 121 is mounted for cleaning and charging. In order to achieve the desired cleaning operation, fluid delivery manifold 122 is mounted in basin 47 and is constructed for engaging foil shaver 121 and delivering the cleaning fluid directly into the hair pocket of foil shaver 121.

In the preferred embodiment, fluid delivery manifold 122 incorporates a plurality of nozzles 123 which are formed thereon and are generally constructed in a manner substantially equivalent to the nozzles detailed above. In addition, foil shaver 121 incorporates portals 124 formed along the rear wall thereof, with portals 124 constructed for aligned, cooperative engagement with nozzles 123. In this way, whenever cleaning system 20 is activated, the cleaning fluid contained therein is forcibly delivered by pump means incorporated in housing 22 directly to fluid delivery manifold 46 for passage through nozzles 123 directly into portals 124.

In this way, the cleaning fluid forcibly enters the hair pocket of foil shaver 121, and is turbulently dispersed therein, cleaning all of the debris from the surfaces of the hair pocket, the cutting blades, and the foil members prior to exiting into basin 47 through the aperture formed in the foil members. Once in basin 47, the cleaning fluid, along with the debris being carried therewith, is returned to the holding zone after the debris is filtered out of the cleaning fluid by passage through the filter means also contained in base portion 23.

By employing this construction, any desired foil shaver can be modified, by incorporating portals therein, for enabling the foil shaver to be quickly, easily, and efficiently thoroughly cleaned of all debris by employing cleaning system 20 of the present invention. As a result, by using the teaching contained herein, both rotary shavers and foil shavers are able to be thoroughly and completely cleaned in a fast, effective, and efficient manner.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A cleaning system constructed for removing hair clipping debris from an interior of a hair cutting end of an electric shaver, said system comprising:

a housing at least partially enclosing said cleaning system;

a support member constructed for receiving and retaining the hair cutting end of the electric shaver, the support member having a delivery port defined therein;

a fluid retaining zone removably coupled to the support member and configured to retain a cleaning fluid therein; and a fluid delivery assembly providing fluid communication between the fluid retaining zone and the support member delivery port, said fluid delivery assembly including a motorized pump and being configured to deliver said cleaning fluid from the fluid retaining zone to the delivery port for delivery directly into the interior of the electric shaver for providing fluid flow through the interior of the hair cutting end of the electric shaver for dislodging and flushingly removing the hair clipping debris therefrom, said fluid delivery assembly having a fluid delivery conduit connected to the motorized pump, the fluid delivery conduit being configured to deliver said cleaning fluid from the fluid retaining zone to the delivery port, the fluid delivery conduit extending from the motorized pump to a holding zone of the support member for being positioned in cooperative, aligned, fluid delivering relationship with a portal formed in the electric shaver whereby cleaning fluid is delivered from the fluid retaining zone directly into the interior of the electric shaver through the shaver portal for providing the fluid flow through the interior of the hair cutting end of the electric shaver for dislodging and flushingly removing the hair debris therefrom.

2. A cleaning system in accordance with claim 1, wherein the housing is constructed for containing the fluid retaining zone and the motorized pump assembly, and the fluid delivery conduit is connected to the support member, the support member being configured to position and hold the portal of the electric shaver in fluid receiving relationship with the delivery port, assuring the flow of the cleaning fluid directly into the interior of the electric shaver.

3. A cleaning system in accordance with claim 1, wherein said housing further comprises:

a base portion comprising the fluid retaining zone; and an upper portion removably mountable to the base portion for enabling easy access to the fluid retaining zone.

4. A cleaning system for removing hair clipping debris from an interior of a hair cutting end of an electric shaver, said system comprising:

a housing at least partially enclosing said cleaning system, wherein the housing comprises a base portion, the base portion comprising:

a bottom surface;

a wall member peripherally surrounding the bottom surface in secure interengagement therewith; and a cover mounted to an inside surface of the wall member in juxtaposed, spaced relationship to the bottom surface to define a fluid retaining zone therebetween;

a support member constructed for receiving and retaining the hair cutting end of the electric shaver, the support member having a delivery port defined therein;

the fluid retaining zone being removably coupled to the support member and configured to retain a cleaning fluid therein; and a fluid delivery assembly providing fluid communication between the fluid retaining zone and the support member delivery port, said fluid delivery assembly including a motorized pump and being configured to deliver said cleaning fluid from the fluid retaining zone to the delivery port for delivery directly into the interior of the electric shaver for providing fluid flow through the interior of the hair cutting end of the electric shaver for dislodging and flushingly removing the hair clipping debris therefrom.

5. A cleaning system in accordance with claim 4, wherein said cover further comprises a receiving portal sized to receive a filter assembly therein.

6. A cleaning system for removing hair clipping debris from an interior of a hair cutting end of an electric shaver, said system comprising.

a housing at least partially enclosing said cleaning system;

a support member constructed for receiving and retaining the hair cutting end of the electric shaver, the support member having a delivery port defined therein;

a fluid retaining zone removably coupled to the support member and configured to retain a cleaning fluid therein;

a fluid delivery assembly providing fluid communication between the fluid retaining zone and the support member delivery port, said fluid delivery assembly including a motorized pump and being configured to deliver said cleaning fluid from the fluid retaining zone to the delivery port for delivery directly into the interior of the electric shaver for providing fluid flow through the interior of the hair cutting end of the electric shaver for dislodging and flushingly removing the hair clipping debris therefrom; and a filter assembly comprising:

a support plate constructed for removable engagement in a receiving portal of a cover of the housing;

an enlarged aperture formed in the support plate for enabling the cleaning fluid to be rapidly passed therethrough; and a filter member defining an enclosed zone with one open end affixed to the support plate, thereby requiring all of the cleaning fluid entering the enlarged aperture of the support plate to pass through the filter member before returning to the fluid retaining zone, thereby enabling all debris within the cleaning fluid to be removed from the cleaning fluid.

7. A cleaning system for removing hair clipping debris from an interior of a hair cutting end of an electric shaver, said system comprising.

a housing at least partially enclosing said cleaning system;

a support member constructed for receiving and retaining the hair cutting end of the electric shaver, the support member having a delivery port defined therein;

a fluid retaining zone removably coupled to the support member and configured to retain a cleaning fluid therein;

a fluid delivery assembly providing fluid communication between the fluid retaining zone and the support member delivery port, said fluid delivery assembly including a motorized pump and being configured to deliver said cleaning fluid from the fluid retaining zone to the delivery port for delivery directly into the interior of the electric shaver for providing fluid flow through the interior of the hair cutting end of the electric shaver for dislodging and flushingly removing the hair clipping debris therefrom; and a filter assembly comprising a diverted plate formed in a support plate of the housing, the diverted plate being in juxtaposed, spaced relationship with an enlarged aperture disposed in the support plate, the diverted plate positioned below the enlarged portal for receiving the cleaning fluid having debris therein and forcing the debris and the cleaning fluid outwardly therefrom.

8. A cleaning system for removing hair clipping debris from an interior of a hair cutting end of an electric shaver, said system comprising:

a housing at least partially enclosing said cleaning system;

a support member constructed for receiving and retaining the hair cutting end of the electric shaver, the support member having a delivery port defined therein;

a fluid retaining zone removably coupled to the support member and configured to retain a cleaning fluid therein; and a fluid delivery assembly providing fluid communication between the fluid retaining zone and the support member delivery port, said fluid delivery assembly including a motorized pump and being configured to deliver said cleaning fluid from the fluid retaining zone to the delivery port for delivery directly into the interior of the electric shaver for providing fluid flow through the interior of the hair cutting end of the electric shaver for dislodging and flushingly removing the hair clipping debris therefrom, the support member comprises a shaver receiving zone comprising a plurality of mounting fins positioned for peripherally surrounding and supportingly maintaining the hair cutting end of the electric shaver in a desired position for enabling the delivery port to be positioned in cooperative, aligned, fluid delivering relationship with a portal formed in the electric shaver.

9. A cleaning system for removing hair clipping debris from an interior of a hair cutting end of an electric shaver, said system comprising:

a housing at least partially enclosing said cleaning system;

a support member constructed for receiving and retaining the hair cutting end of the electric shaver, the support member having a delivery port defined therein;

a fluid retaining zone removably coupled to the support member and configured to retain a cleaning fluid therein; and a fluid delivery assembly providing fluid communication between the fluid retaining zone and the support member delivery port, said fluid delivery assembly including a motorized pump and being configured to deliver said cleaning fluid from the fluid retaining zone to the delivery port for delivery directly into the interior of the electric shaver for providing fluid flow through the interior of the hair cutting end of the electric shaver for dislodging and flushingly removing the hair clipping debris therefrom, the electric shaver comprises a plurality of fluid receiving portals formed in an outer surface thereof for enabling fluid delivered therethrough to enter directly into a hair pocket of the electric shaver; and the support member comprises a fluid distribution manifold mounted in a shaver receiving zone of the support member, the fluid distribution manifold comprising a plurality of fluid delivery nozzles positioned for aligned, cooperative, fluid delivering relationship with the plurality of fluid receiving portals formed in the electric shaver, whereby the cleaning fluid passing through the fluid distribution manifold and is channeled through the plurality of fluid delivery nozzles and the plurality of fluid receiving portals of the electric shaver directly into the hair pocket of the electric shaver.

10. A cleaning system in accordance with claim 9, wherein each fluid delivery nozzle of the plurality of fluid delivery nozzles comprises a rounded outer surface, assuring easy, aligned engagement of each fluid delivery nozzle with a respective fluid receiving portal of the plurality of fluid receiving portals of the electric shaver.

11. A cleaning system in accordance with claim 9, wherein the fluid distribution manifold comprises an overall U-shape constructed for peripherally surrounding and easily engaging the outer surface of the electric shaver with terminating ends of the fluid distribution manifold being flexibly movable for assuring rapid, easy mounted engagement thereof with the electric shaver.

12. A cleaning system for removing hair clipping debris from an interior of a hair cutting end of an electric shaver, said system comprising:

a housing at least partially enclosing said cleaning system;

a support member constructed for receiving and retaining the hair cutting end of the electric shaver, the support member having a delivery port defined therein;

a fluid retaining zone removably coupled to the support member and configured to retain a cleaning fluid therein; and a fluid delivery assembly providing fluid communication between the fluid retaining zone and the support member delivery port, said fluid delivery assembly including a motorized pump and being configured to deliver said cleaning fluid from the fluid retaining zone to the delivery port for delivery directly into the interior of the electric shaver for providing fluid flow through the interior of the hair cutting end of the electric shaver for dislodging and flushingly removing the hair clipping debris therefrom, the support member comprises a fluid collection device comprising a base surface formed in a shaver receiving zone of the support member, the base surface positioned below the hair cutting end of the electric shaver and comprising an enlarged aperture formed therein, the base surface being sloped for directing all cleaning fluid and debris coming in contact therewith directly to the enlarged aperture.

13. A cleaning system in accordance with claim 12, wherein the enlarged aperture formed in the base surface is directly aligned with a filter assembly for enabling all cleaning fluid and debris passing through the enlarged aperture to be delivered directly to the filter assembly.

14. A method for cleaning hair clipping debris from an interior of a hair cutting end of an electric shaver using a cleaning system at least partially enclosed by a housing, said method comprising:

supporting the electric shaver in a support member of the cleaning system, the hair cutting end of the electric shaver being received in and retained by the support member;

removably coupling a fluid retaining zone to the support member, the fluid retaining zone configured to retain a cleaning fluid therein;

withdrawing the cleaning fluid from the fluid retaining zone using a fluid delivery assembly communicating with the fluid retaining zone, the fluid delivery assembly including a motorized pump and a delivery port, the delivery port defined within the support member; and delivering the cleaning fluid directly into the interior of the electric shaver through the delivery port to provide fluid flow through the interior of the hair cutting end of the electric shaver for dislodging and flushingly removing the hair clipping debris therefrom, and cyclically operating the motorized pump for delivering and ceasing the delivery of cleaning fluid directly to the interior of the electric shaver for a period of time ranging between about two minutes and about eight minutes, followed by activating a fan assembly to deliver an air flow to the shaver for between about 15 minutes and about 22 minutes.

15. A method in accordance with claim 14 further comprising:

channeling the cleaning fluid with the hair clipping debris through a filter assembly mounted in the housing between the support member and the fluid retaining zone, the filter assembly constructed for enabling all of the cleaning fluid and the hair clipping debris emanating from the electric shaver to flow therethrough; and returning the filtered cleaning fluid to the fluid retaining zone.

16. A method on accordance with claim 15, wherein channeling the cleaning fluid with the hair clipping debris through a filter assembly further comprises channeling the cleaning fluid with the hair clipping debris along an inverted V-shaped diverter plate to force the hair clipping debris and the cleaning fluid outwardly towards a filter member.

* * * * *